US006176480B1

(12) United States Patent
Yonenuma et al.

(10) Patent No.: US 6,176,480 B1
(45) **Date of Patent: *Jan. 23, 2001**

(54) SHEET STACKING APPARATUS

(75) Inventors: Masahiro Yonenuma, Tokyo; Hideaki Furukawa; Noriaki Nakazawa, both of Yokohama, all of (JP)

(73) Assignee: Canon Aptex Kabushiki Kaisha, Ibaraki-ken (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/693,703

(22) Filed: Aug. 7, 1996

(30) Foreign Application Priority Data

Aug. 9, 1995 (JP) ..... 7-203581
Aug. 9, 1995 (JP) ..... 7-203627

(51) Int. Cl.[7] ..... B65H 39/02
(52) U.S. Cl. ..... 270/58.08; 271/258
(58) Field of Search ..... 270/58.02, 58.08; 271/258

(56) References Cited

U.S. PATENT DOCUMENTS 4,484,070 * 11/1984 Inoue ..... 271/258
4,520,263 * 5/1985 Kitamura ..... 250/223
5,017,972 * 5/1991 Daughton et al. ..... 355/321
5,614,987 * 3/1997 Nishioka et al. ..... 270/58.02

FOREIGN PATENT DOCUMENTS 31 41 615 A1 * 6/1982 (DE) .
40 13 423 A1 * 10/1991 (DE) .
0 298 510 A2 * 1/1989 (EP) .
0 562 387 A1 * 9/1993 (EP) .
57-145764 * 9/1982 (JP) .

OTHER PUBLICATIONS

Patent Abstracts of Japan, vol. 006, No. 249 (M–177), Dec. 8, 1982, relating to JP 57–145764, published Sep. 8, 1982.*
Elektro–Technik, No. 33, Oct. 12, 1966, Wurzburg DE, pp. 772–773, "Fotoelektronische Steurerung Von Papier–Und Pappenstapeln".*

* cited by examiner

*Primary Examiner*—John T. Kwon
(74) *Attorney, Agent, or Firm*—Fitzpatrick, Cella, Harper & Scinto

(57) ABSTRACT

An apparatus for stacking discharged sheets on a sheet stacking plate, including a distance sensor disposed above the sheet stacking plate and having a light illumination portion for illuminating the sheet stacking plate and a light receiving portion for receiving reflected light, and a control device for determining the distance between the distance sensor and a sheet stack resting on the sheet stacking plate and for determining a sheet stacking condition of the sheet stacking plate on the basis of the determined distance.

46 Claims, 33 Drawing Sheets

SHEET STACKING APPARATUS

BACKGROUND OF THE INVENTION

1. Field of the Invention

The present invention relates to a sheet stacking apparatus in which sheets discharged from an image forming apparatus such as a copying machine, a laser beam printer and the like are stacked on a sheet stacking plate, and an image forming apparatus having such a sheet stacking apparatus, and more particularly, it relates to control of a position of such a sheet stacking plate.

2. Related Background Art

Among conventional image forming apparatuses such as copying machines, laser beam printers and the like, there is an image forming apparatus having a post-treatment apparatus for effecting a post-treatment such as sheet stapling. In such a post-treatment apparatus, as shown in FIG. 42, a tray (sheet stacking plate) 103 on which sheets are stacked is provided on a lift/lower tray shifting stage 102. On the other hand, an upper rockable guide 88 is provided with a sheet level detection sensor 105 for detecting the fact that a height of a sheet stack S comprised of sheets discharged on the tray 103 reaches a predetermined level. The sheet level detection sensor 105 includes a pivotable sensor lever 106 contacted with the sheet stack S rested on the tray 103 and having an upper end pivotablly supported, and a photo-sensor 107 for emitting a signal representing the fact that the height of the sheet stack S reaches the predetermined level when the sensor lever 106 is rotated by a predetermined angle.

Incidentally, the sensor lever 106 is gradually rocked upwardly as the sheets S are successively stacked on the tray 103, and, when the height of the sheet stack S reaches the predetermined level, the sensor lever reaches the predetermined angle. With this arrangement, the sheet level detection sensor 105 can detect the fact that the height of the sheet stack S reaches the predetermined level.

When the fact that the height of the sheet stack S reaches the predetermined level is detected by the sheet level detection sensor 105 in this way, a tray lift/lower motor provided on the tray shifting stage 102 is driven, so that the tray 103 is lowered to substantially a position where a first sheet is discharged on the tray. As a result, it is possible to prevent any sheet from jamming at a sheet discharge opening 50 and to increase a maximum stackable amount of sheets on the tray 103.

Recently, there have been proposed sheet stacking apparatuses each having a plurality of trays. In such sheet stacking apparatuses, for example, when the sheets are successively received one by one in trays from an uppermost one to a lowermost one, after a maximum allowable sheets are stacked on a certain tray, it is necessary that this tray is shifted above the discharge opening and a next (lower) tray is shifted below the discharge opening.

However, when the tray on which the sheets were fully stacked is shifted, as is in the conventional case, if the conventional sheet level detection sensor is provided, since the sensor lever interferes with the movement of the tray, there must be provided for retarding the sensor lever to a position where the sensor lever does not interfere with the movement of the tray whenever the tray is lifted, thereby making the apparatus complicated.

Further, since the conventional sheet level detection sensor cannot detect whether the sheets are stacked on the tray or not, for example, there arises a problem that a different kind of sheet is stacked on the tray on which a certain kind of sheets were already stacked.

SUMMARY OF THE INVENTION

Therefore, the present invention intends to eliminate the above-mentioned conventional drawbacks, and has an object to permit detection of a sheet with a simple construction. Another object of the present invention is to provide a sheet stacking apparatus and an image forming apparatus having such a sheet stacking apparatus, in which, even when a plurality of sheet stacking plates are provided, the positions of the sheet stacking plates can easily be controlled with a simple construction and the presence/absence of sheets on the sheet stacking plates can be detected.

The present invention provides a sheet stacking apparatus for stacking sheets on a sheet stacking plate, comprising a drive device for shifting the sheet stacking plate in an up-and-down direction, a distance sensor disposed above the sheet stacking plate having a light projecting portion for illuminating light toward the sheet stacking plate and a light receiving portion for receiving reflected light, a stacking plate position detection means for detecting a height position of the sheet stacking plate, and a control device for determining the distance between the distance sensor and a sheet stack rested on the sheet stacking plate and for determining the height of the sheet stack on the sheet stacking plate on the basis of the determined distance and the height position detected by the stacking plate position detection means.

Further, the present invention provides the above-mentioned sheet stacking apparatus with a stapling means and the light receiving portion of the distance sensor includes a PSD light receiving element and the illumination portion is designed to emit the light whenever the stapling operation is effected, on the basis of a signal from the control device.

Further, in the present invention, the control device determines that a maximum amount of sheets are stacked on the sheet stacking plate when the height of the sheet stack becomes greater than a first predetermined height and judges that no sheet is stacked on the sheet stacking plate when the height of the sheet stack is smaller than a second predetermined height.

Furthermore, in the sheet stacking apparatus according to the present invention, a through opening for permitting passage of the projected light from the distance sensor is formed in the sheet stacking plate so that, when no sheet is stacked on the sheet stacking plate, the projected light is passed through the through opening to indicate the fact that the height of the sheet stack becomes smaller than the second predetermined height.

The present invention can also be applied to an image forming apparatus comprising an image forming portion and a sheet stacking apparatus for containing sheets on which images were formed in the image forming portion.

With the arrangement as mentioned above, the control device determines the distance between the distance sensor disposed above the sheet stacking plate and an upper surface of the sheet stack rested on the sheet stacking plate. On the basis of the determined distance and the height position detected by the stacking plate position detection means, the height of the sheet stack on the sheet stacking plate is determined. In accordance with the determined result, the drive device is driven to shift the sheet stacking plate.

On the other hand, the present invention provides a sheet stacking apparatus for stacking sheets on a sheet stacking plate, comprising a distance sensor of non-contact type disposed above a sheet stacking plate and having a light illumination portion for projecting light toward the sheet stacking plate and a light receiving portion for receiving reflected light, and a control device for determining the distance between the distance sensor and a sheet stack rested on the sheet stacking plate and for determining a sheet stacking condition of the sheet stacking plate on the basis of the determined distance.

Further, the present invention provides the above-mentioned sheet stacking apparatus further comprising a stapling means and the light receiving portion of the distance sensor includes a PSD light receiving element and the illumination portion is designed to emit the light whenever the stapling operation is effected, on the basis of a signal from the control device.

Further, in the present invention, the control device determines that a predetermined amount of sheets are stacked on the sheet stacking plate when the distance becomes smaller than a first predetermined distance, thereby driving the drive device to lower the sheet stacking plate and judges that no sheet is stacked on the sheet stacking plate when the distance is greater than a second predetermined distance.

Furthermore, in the sheet stacking apparatus according to the present invention, a through opening for permitting passage of the projected light from the distance sensor is formed in the sheet stacking plate so that, when no sheet is stacked on the sheet stacking plate, the illumination light is passed through the through opening to indicate the fact that the distance becomes greater than the second predetermined distance.

The present invention can also be applied to an image forming apparatus comprising an image forming portion and a sheet stacking apparatus for effecting a post-treatment regarding sheets on which images were formed in the image forming portion.

With the arrangement as mentioned above, the control device determines the distance between the distance sensor of non-contact type disposed above the sheet stacking plate and an upper surface of the sheet stack rested on the sheet stacking plate. On the basis of the determined distance, the sheet stacking condition of the sheet stacking plate is determined. In accordance with the determined result, the drive device is driven to shift the sheet stacking plate.

According to the present invention, the height on the sheet stacking plate can be determined easily and correctly. Further, since the height of the sheet stack rested on the sheet stacking plate is determined by the distance sensor and the stacking plate position detection means and the sheet stacking plate can be shifted on the basis of the determined result, the position of the sheet stacking plate can be controlled without interference with the distance sensor.

Further, the through opening is formed in the sheet stacking plate so that, when no sheet is stacked on the sheet stacking plate, the projected light is passed through the through opening to indicate the fact that the distance between the distance sensor and the sheet stacking plate becomes greater than the second predetermined distance. With this arrangement, the presence/absence of the sheet on the sheet stacking plate can be detected.

DETAILED DESCRIPTION OF THE PREFERRED EMBODIMENTS

The present invention will now be explained in connection with embodiments thereof with reference to the accompanying drawings.

Figure 1:
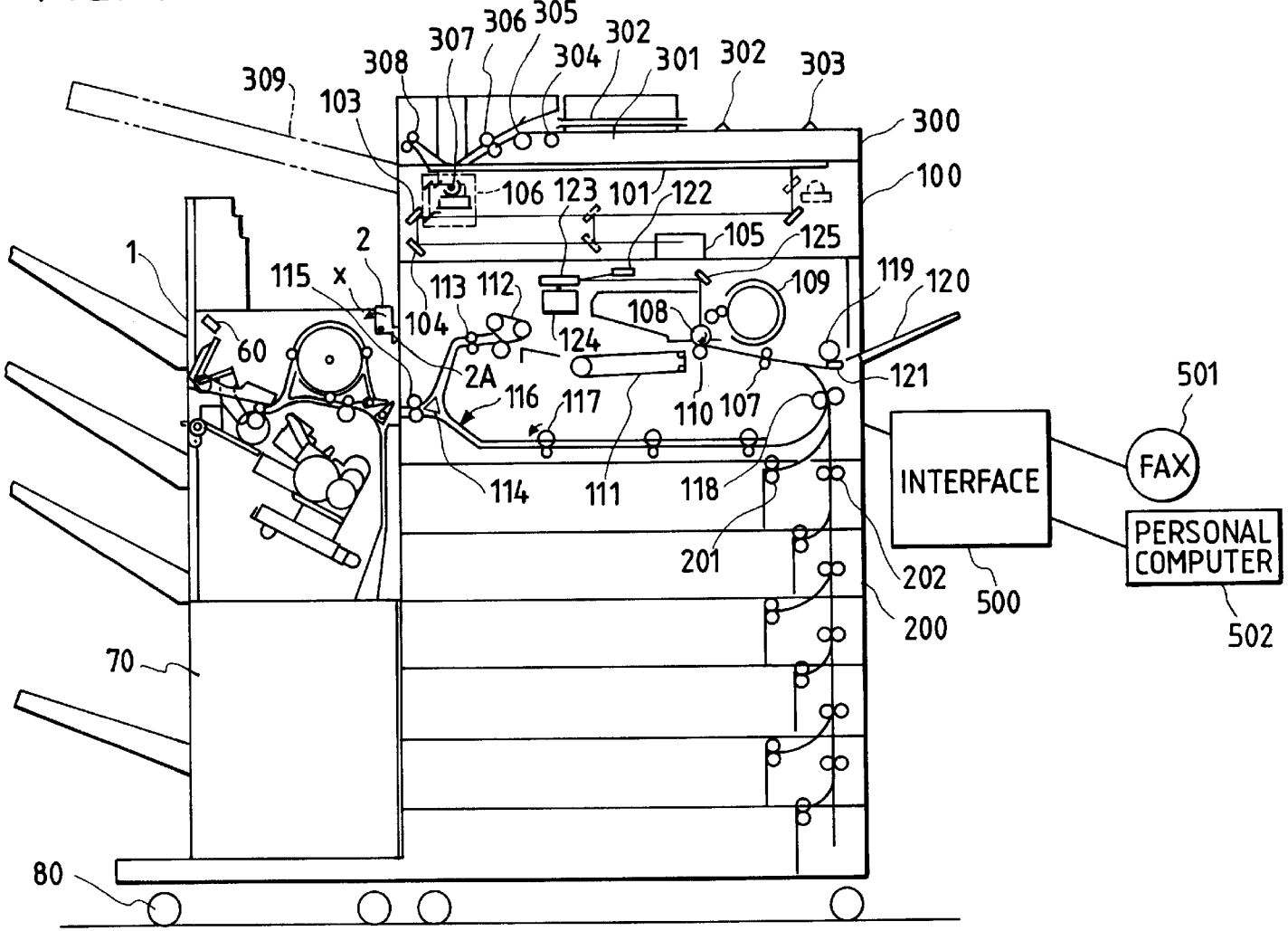
FIG. 1 is a side sectional view of a sheet stacking apparatus and an image forming apparatus according to the present invention.

FIG. 1 shows an internal construction of a copying machine as an example of an image forming apparatus to which the present invention can be applied. In FIG. 1, the reference numeral 1 denotes a sheet stacking apparatus according to the present invention; 100 denotes a copying machine; 200 denotes a cassettes containing sheets having different sizes; and 300 denotes an original supplying apparatus or automatic document feeder (referred to as "ADF" hereinafter).

The copying machine 100 comprises an original platen glass 101, scan reflection mirrors (scan mirrors) 103 and 104 for changing light path for light reflected by an original, a lens 105 having a focusing function and a magnification change function, and a first scan mirror portion having an illumination lamp for reading the original supplied from the ADF 300 and a mirror.

The copying machine further comprises a pair of regist rollers 107, a photosensitive drum 108, a pressure roller 110, a convey belt 111 for conveying a recording sheet on which an image was recorded to a fixing device 112 for fixing the image to the recording sheet, convey rollers 113 and 117 for conveying the recording sheets, a flapper 114 for switching or changing a conveying direction of the recording sheet, a pair of convey rollers 115 for conveying the recording sheet toward the sheet stacking apparatus 1, a reverse rotation path 116 for turning up the recording sheet, a pair of convey rollers 118 for conveying the recording sheet supplied from any one of cassettes 200 to a photosensitive drum unit portion, and a portion including a roller 119, a tray 120 and a separation pad 121 which elements 119–121 serve to convey a recording sheet supplied from a manual sheet insertion unit.

The copying machine further includes a laser 122 for forming an image on the photosensitive drum, a polygon mirror 123, a mirror 125 for changing a light path, and a motor 124 for driving the polygon mirror 123. In association with each cassette 200, there are provided a pair of convey rollers 201 for picking up the recording sheet from the corresponding cassette 200, and a pair of intermediate rollers 202 for feeding the recording sheet picked-up from the cassette 200.

A surface of the photosensitive drum 108 is formed from a seamless photosensitive body using photo-conductive material and electrically-conductive material, and the photosensitive drum 108 is rotatably supported so that, when a copy start key is depressed, the drum is rotated in a direction shown by the arrow in FIG. 1 by means of a main motor (not shown). Incidentally, when predetermined rotation control and potential control for the drum 108 are completed, the original rested on the original platen glass 101 is illuminated by the light from the illumination lamp of the first scan mirror portion 106, and the light reflected from the original is passed through the scan mirrors 103, 104 and the lens 105 and is focused on a light receiving element of the lens unit.

In the light receiving element, the light reflected from the original is converted into an electric signal which is in turn sent to an image process portion (not shown). On the other hand, in the image process portion, after predetermined data treatment inputted by the operator is performed, the signal is sent to the laser 112. The data-treated electric signal is converted into light in the laser portion 112. Then, the light is incident on the photosensitive drum 108 through the polygon mirror 123 and the mirror 125 to form an electrostatic latent image on the drum. The latent image is then visualized by toner as a toner image, and the toner image is transferred onto the recording sheet (transfer sheet), as will be described later.

On the other hand, the recording sheet (transfer sheet) supplied from cassette 200 or the manual insertion tray 120 is sent toward the interior of the copying machine by the rollers 118, 201, 202 or the roller 119 and then is sent to the photosensitive drum 108 with a predetermined timing controlled by the pair of regist rollers 107 so that an image tip end of toner image is aligned with a tip end of the transfer sheet. Thereafter, while the transfer sheet is being passed between the photosensitive drum 108 and the roller 110, the toner image on the drum 108 is transferred onto the transfer sheet.

Then, the transfer sheet is separated from the drum 108, and the separated transfer sheet is sent, through the convey belt 111, to the fixing device 112, where the image is fixed to the transfer sheet with heat and pressure. The transfer sheet to which the image was fixed is introduced into the path 116 through the flapper 114. When a trail end of the transfer sheet leaves the flapper 114, the pair of convey rollers 117 are rotated in a direction opposite to a direction shown by the arrow. As a result, the sheet is moved along the path 116 in the opposite direction so that the trail end of the sheet is directed toward the discharge rollers 115 by the flapper 114. In this way, the sheet is outputted to the sheet stacking apparatus with the imaged surface facing downwardly.

On the other hand, the ADF 300 comprises a stacking tray 301 on which the originals 302 are stacked with images surfaces facing downwardly, a pickup roller 304 for feeding out the originals one by one from a lowermost original, a separation means 305 for separating the originals one by one if several originals are supplied simultaneously, and a pair of regist rollers 306 for effecting registration of a tip end of the original. Incidentally, the original passed through the regist rollers 306 is sent to a reading portion 307, where the original is read in a condition wherein the first scan mirror unit 106 is fixed (so-called "flow-reading"). Then, the original is discharged onto a discharge tray 309 through a pair of discharge rollers 308.

A stopper member 2 is provided on an upper portion of the sheet stacking apparatus 1, so that, when the sheet stacking apparatus is connected to the copying machine 100, the stopper member 2 is engaged by a hold portion 2A formed on a side surface of the copying machine 100, thereby positioning and holding the sheet stacking apparatus. Further, a folding unit or an attachment base 70 having casters 80 is provided below the sheet stacking apparatus.

With the arrangement as mentioned above, when a jam treatment is performed in the vicinity of the discharge portion of the copying machine or at a transit portion between the sheet stacking apparatus 1 and the copying machine 100, first of all, the stopper member 2 is released and then the sheet stacking apparatus 1 is shifted to be separated from the copying machine 110. As a result, the jam treatment can easily be performed.

Figure 2:
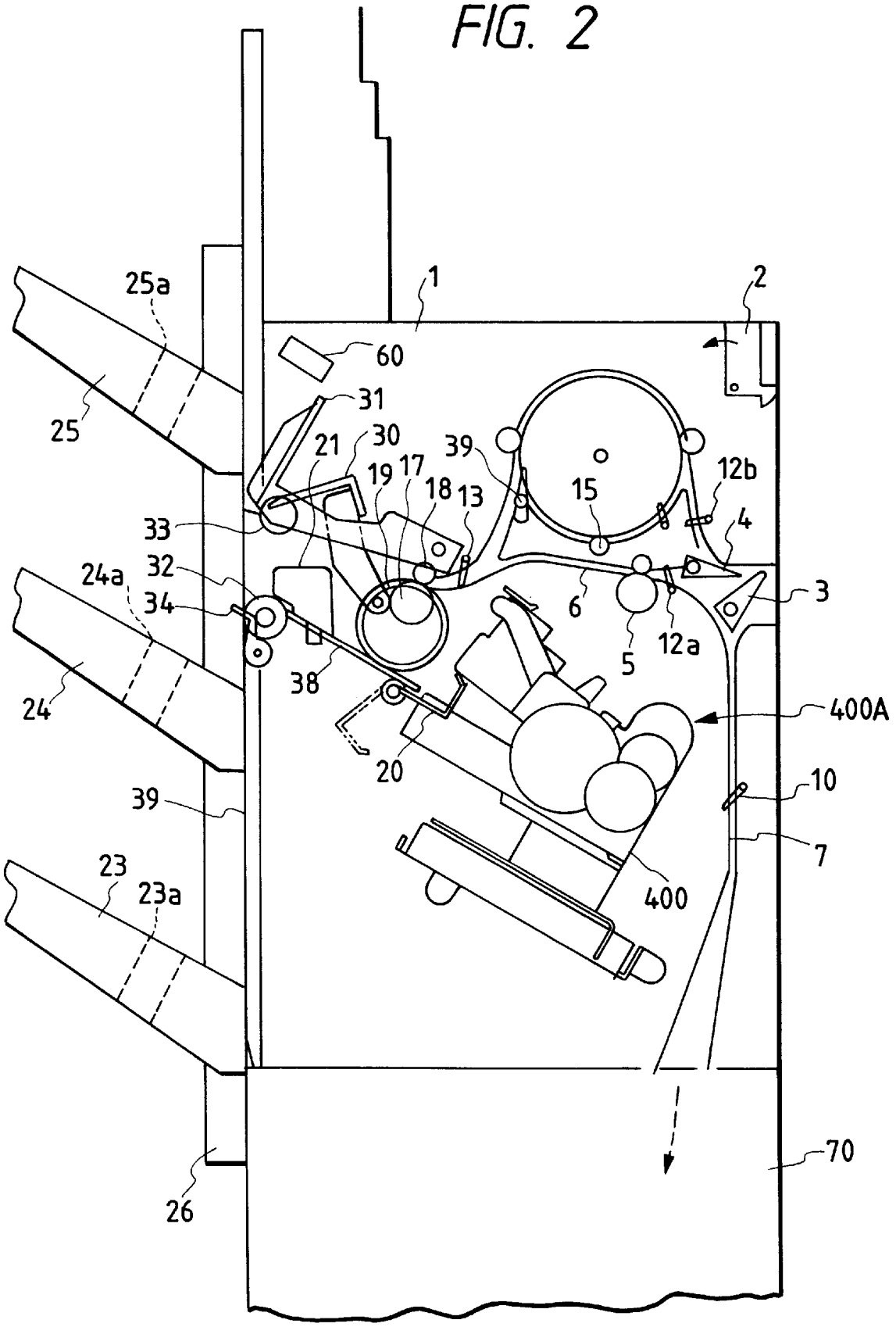
FIG. 2 is a side sectional view of the sheet stacking apparatus.

On the other hand, when the sheets discharged from the discharge portion of the copying machine 100 are treated in the sheet stacking apparatus 1, in FIG. 2, an upstream end of a flapper 3 is shifted downwardly and an upstream end of a flapper 4 is shifted upwardly. As a result, the sheet is introduced into a first convey path 6 via a pair of rollers 5. Incidentally, when the sheet is sent to the folding unit 70, the upstream end of the flapper 3 is shifted upwardly, with the result that the sheet is sent toward a direction shown by the broken line arrow through a third convey path 7.

Incidentally, in FIG. 2, the reference numeral 8 denotes a second convey path; 9 denotes a buffer roller; 14, 15 and 16 denote buffer rollers; 10, 11, 12 and 13 denote sheet detection sensors for detecting the sheet passing therethrough or trapped therein; 17 denotes a first discharge roller; 18 denotes a hold-down roller; 19 denotes a discharge align belt pinched and rotated between the first discharge roller 17 and the hold-down roller 18 and having an endless rib (not shown) at its central portion on its inner surface to prevent the dismounting of the belt. The belt is driven by rotation of the first discharge roller 17.

Figure 3:
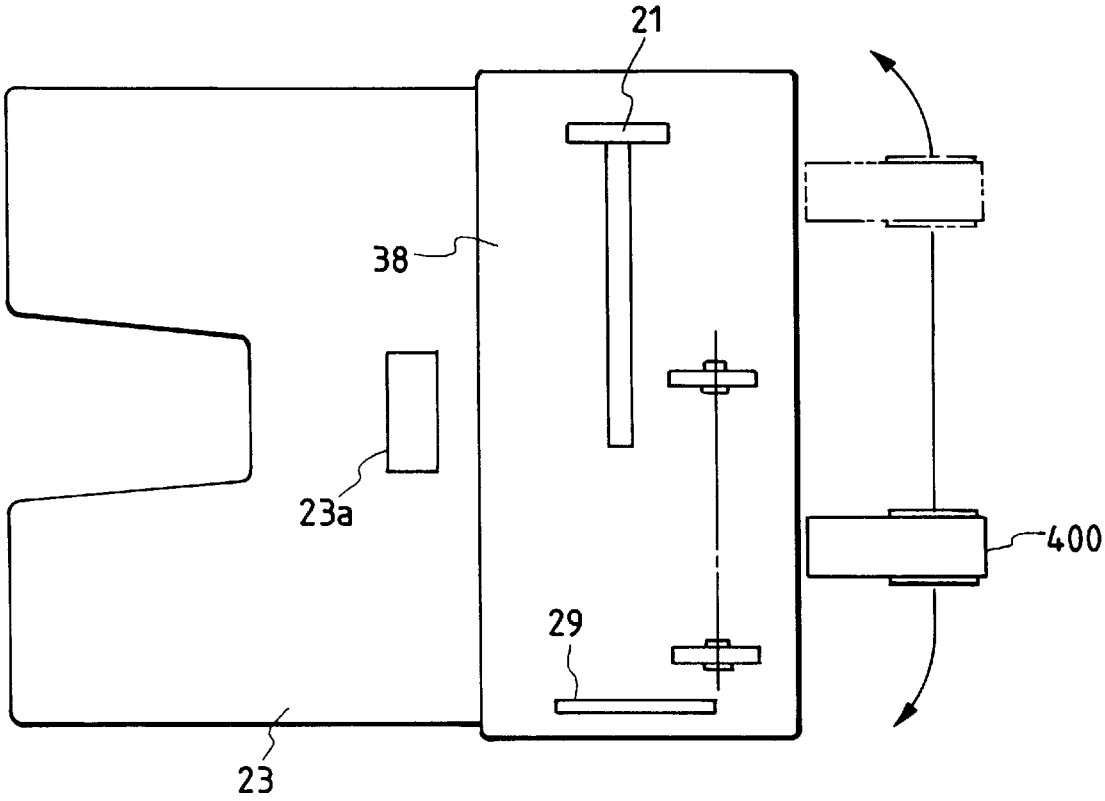
FIG. 3 is a plan view of a staple tray portion of the sheet stacking apparatus.
Figure 4:
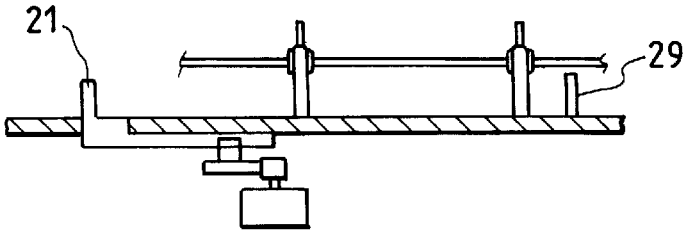
FIG. 4 is a side sectional view of the staple tray portion.

Further, when the stapling operation (described later) is performed, the trail end of the sheet abuts against an abutment member 20 so that the sheet is aligned in a longitudinal direction. The abutment member 20 can be shifted between a home position where the trail end of the sheet is aligned and a retard position where the abutment member does not interfere with a movement of a stapler 400. That is to say, when the stapler 400 is shifted, the abutment member is rotated to the retard position shown by the broken line so that the shifting movement of the stapler is not obstructed by the abutment member. On the other hand, as shown in FIGS. 3 and 4, the alignment of the sheet in a width-wise direction is effected by a side align guide 21. Further, the stapler 400 is shifted within a range shown by the arrows in FIG. 3 to effect two-points stapled at intermediate positions and front and rear ones stapled at both end positions. Incidentally, in FIG. 3, the reference numeral 29 denotes an align reference plate.

Figure 5:
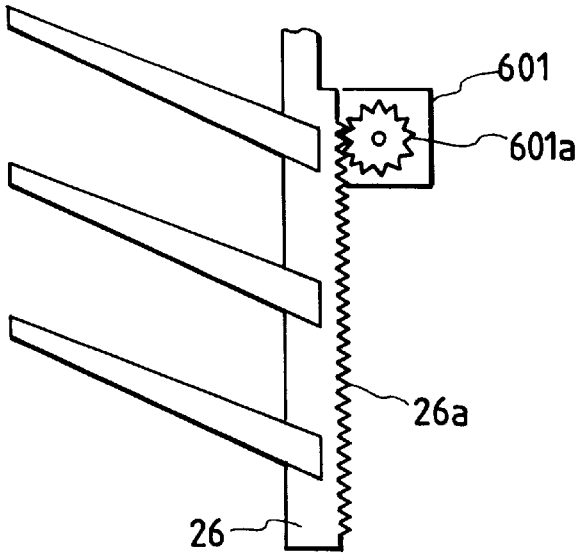
FIG. 5 is a side view of a main portion of a tray unit of the sheet stacking apparatus.

In FIG. 2, the reference numerals 23, 24 and 25 denote first, second and third trays on which the sheets are discharged from a discharge opening 50; and 26 denotes a tray unit (stacking plate unit) which can be shifted in an up-and-down direction while holding the first, second and third trays 23, 24, 25. The tray unit 26 has a rack gear 26*a* (FIG. 5) meshed with a lift/lower gear 601*a* of a shift motor (drive device) 601. Thus, the tray unit can be shifted in the up-and-down direction by driving the shift motor.

Figure 6:
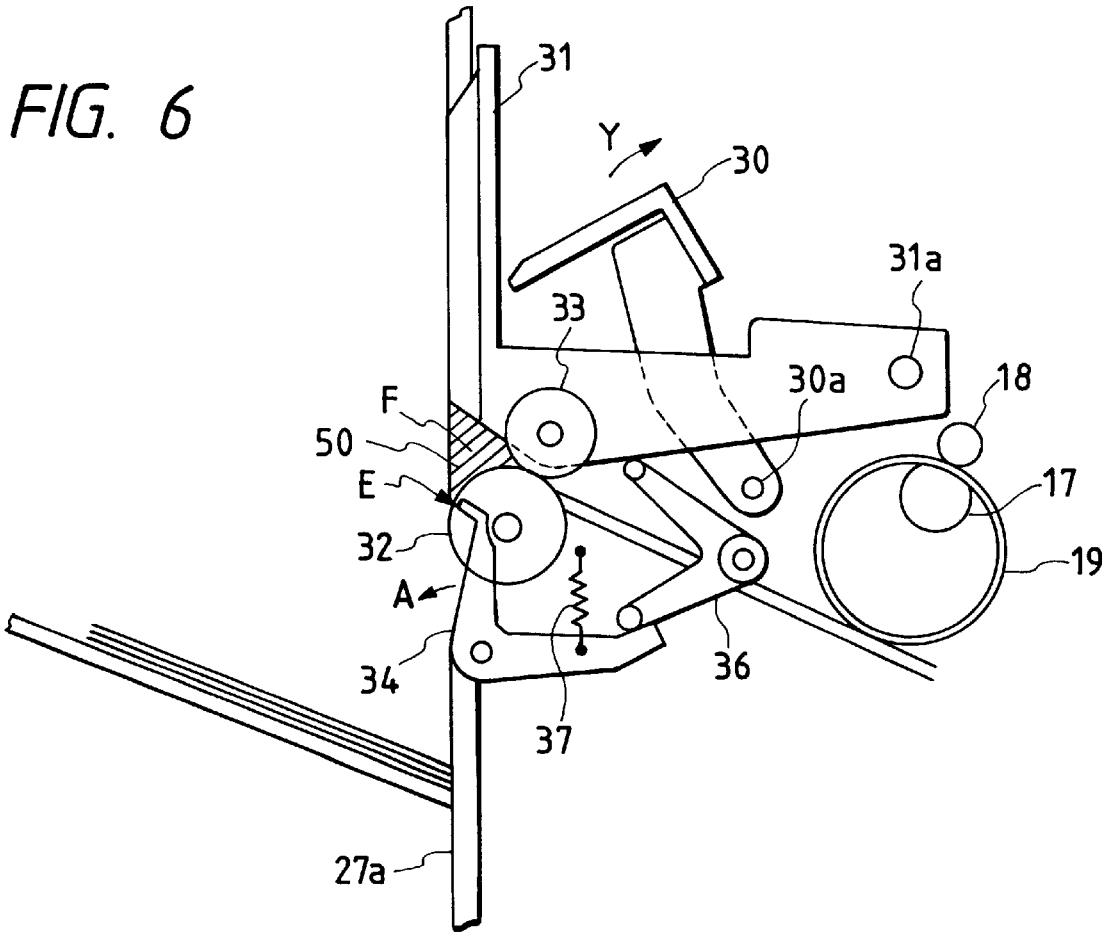
FIG. 6 is an enlarged sectional view of the main portion of the sheet stacking apparatus.
Figure 9:
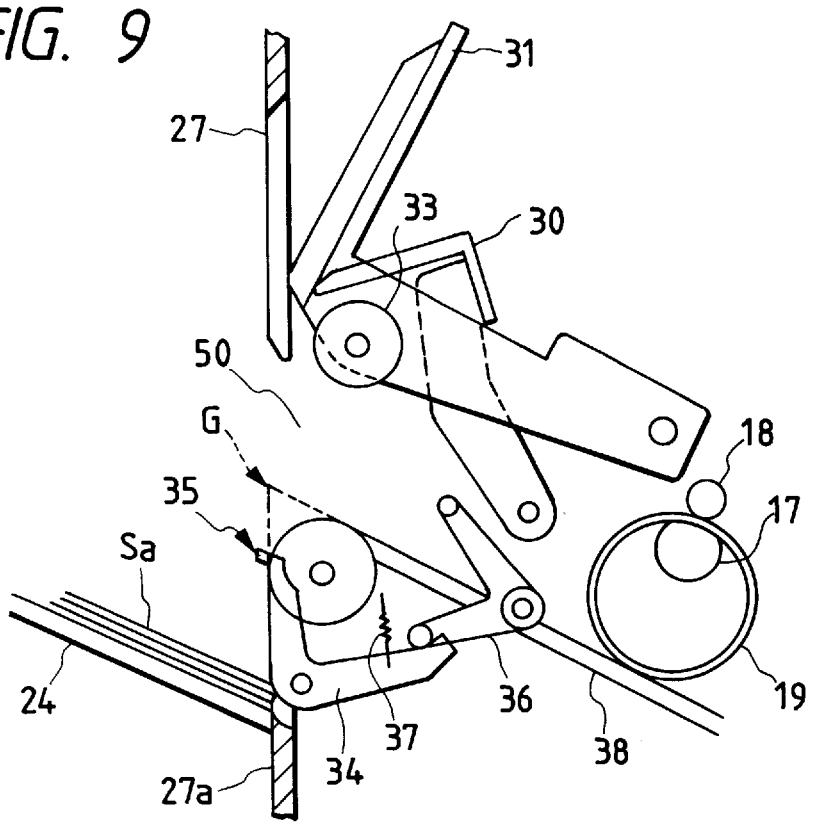
FIG. 9 is an explanatory view showing a condition wherein the rockable guide is rocked upwardly.

Further, as shown in FIG. 2 and 6, a rockable guide 31 serves to rotatably hold a shiftable discharge roller 33. When the sheet is discharged, the rockable guide is rocked around a pivot pin 31*a* by rotating a cam 35 (FIG. 7) in a direction shown by the arrow (FIG. 7) by means of a discharge motor 35*a*, thereby urging the shiftable discharge roller 33 against the discharge roller 32. Incidentally, in a staple mode (described later), as shown in FIG. 9, the rockable guide 31 is rocked to an upper position where the shiftable discharge roller 33 is separated from the discharge roller 32. In this position, a pair of rollers comprised of the shiftable discharge roller 33 and the discharge roller 32 cannot discharge the sheet.

Figure 8:
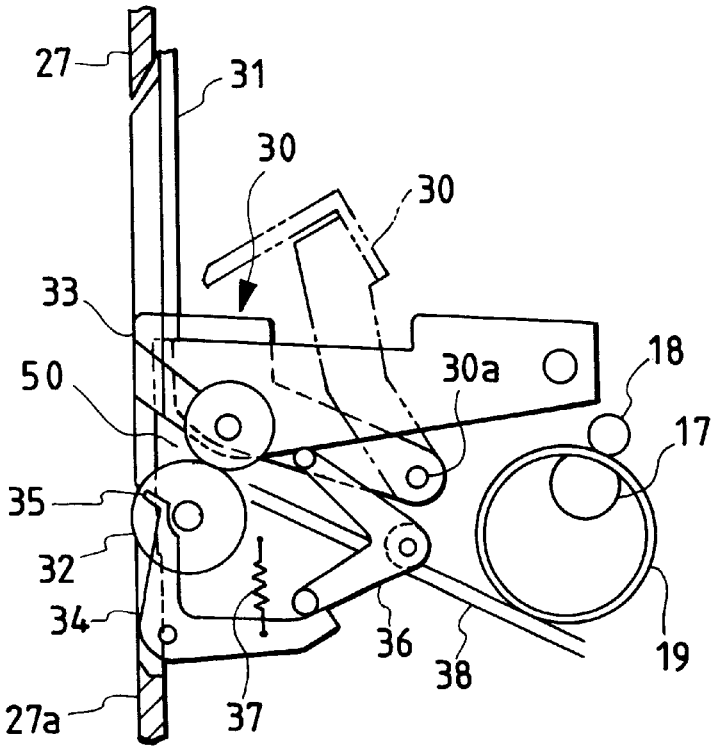
FIG. 8 is an explanatory view showing a condition wherein a discharge opening is closed by a stopper of the sheet stacking apparatus.

On the other hand, when the tray unit is shifted, a stopper 30 (FIG. 6) is rocked around a pivot pin 30*a* to close the discharge opening 50, as shown by the solid line in FIG. 8. By closing the discharge opening 50 in this way, when the tray is being passed through the discharge opening 50, the sheets stacked on the tray can be prevented from re-entering into discharge opening 50. Incidentally, in FIG. 8, the reference numeral 27 denotes an upper net guide. Further, when the sheet is discharged, the stopper 30 is rocked in a direction shown by the arrow Y in FIG. 6, thereby opening the discharge opening 50. And, in the staple mode (described later), as is in the rockable guide 31, the stopper opens the discharge opening 50, as shown in FIG. 9.

Figure 10:
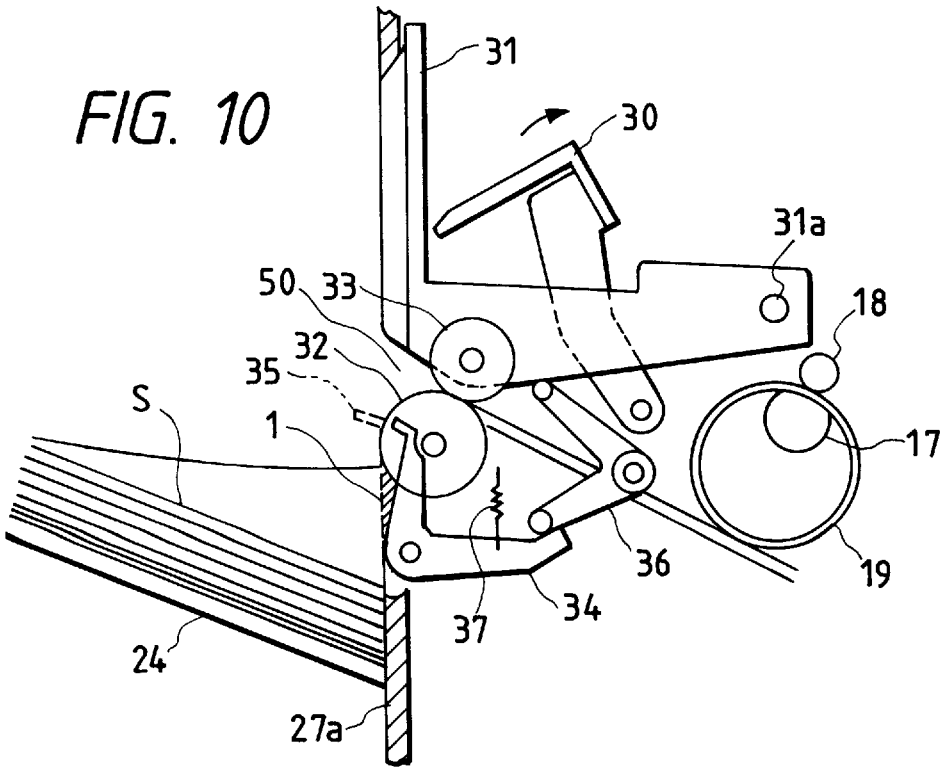
FIG. 10 is an explanatory view showing a position where an escape portion is formed by a roller guide of the sheet stacking apparatus.

Further, in FIG. 6, a roller guide 34 is pivotally supported between a lower net guide 27*a* and the discharge opening 50 and is provided at its upper end with an outwardly extending locking pawl 35 (FIG. 8). When the rockable guide 31 is rocked downwardly, the roller guide 34 is rocked while expanding a spring 37 via a link 36, with a result that the roller guide is retarded to a retard position where a tip end of the locking pawl 35 is retracted into the interior of the copying apparatus 1 further than a forward end of the discharge roller 32. Consequently, when the sheet is discharged, the sheet S can be prevented from being caught between the roller guide 34 and the discharge roller 32, thereby surely discharging the sheet S. Further, as shown in FIG. 10, an escape surface shown by a hatched area I can be formed between the lower net guide 27*a* and the roller guide, thereby smoothly guiding the sheet S to the tray 24.

As shown in FIG. 6, the roller guide 34 is biased toward a direction shown by the arrow A by means of the spring 37, so that, in the staple mode, the roller guide is maintained flush with the lower net guide 27*a* by the spring 37 as shown in FIG. 9. As a result, in the staple mode, even if an inclined end of the sheet stack Sa rested on the tray is flexed upward, the inclined end can be prevented from being caught between the lower net guide 27*a* and the discharge roller 32.

Further, in the staple mode, as shown in FIG. 9, the locking pawl 35 is protruded above the tray 24. Consequently, even if the inclined end of the sheet stack Sa is flexed upward, a free end of the inclined end portion of the sheet stack is prevented from exceeding a point G, so that a next sheet can be prevented from being caught by the inclined end to prevent sheet jam, and, the burden to the operation of the side align guide 21 can be eliminated, thereby preventing the aligning ability of the side align guide from being worsened.

In FIG. 2, there is provided a distance sensor 60 of non-contact type having an illumination portion for emitting light toward the tray 23, 24 or 25 and a light receiving portion for receiving reflected light. For example, in the staple mode, whenever a stapling operation is performed, a CPU (control device) (described later) drives the distance sensor 60 to emit the light toward the trays 23, 24 and 25 and determines the distances between the distance sensor 60 and the sheet stack rested on the trays 23, 24 or 25 on the basis of a position of received light on the light receiving portion. In the staple mode, after the sheet bundle (stack) is stapled by staple needles, the sheet bundle is discharged onto the tray 23, 24 or 25.

Figure 11:
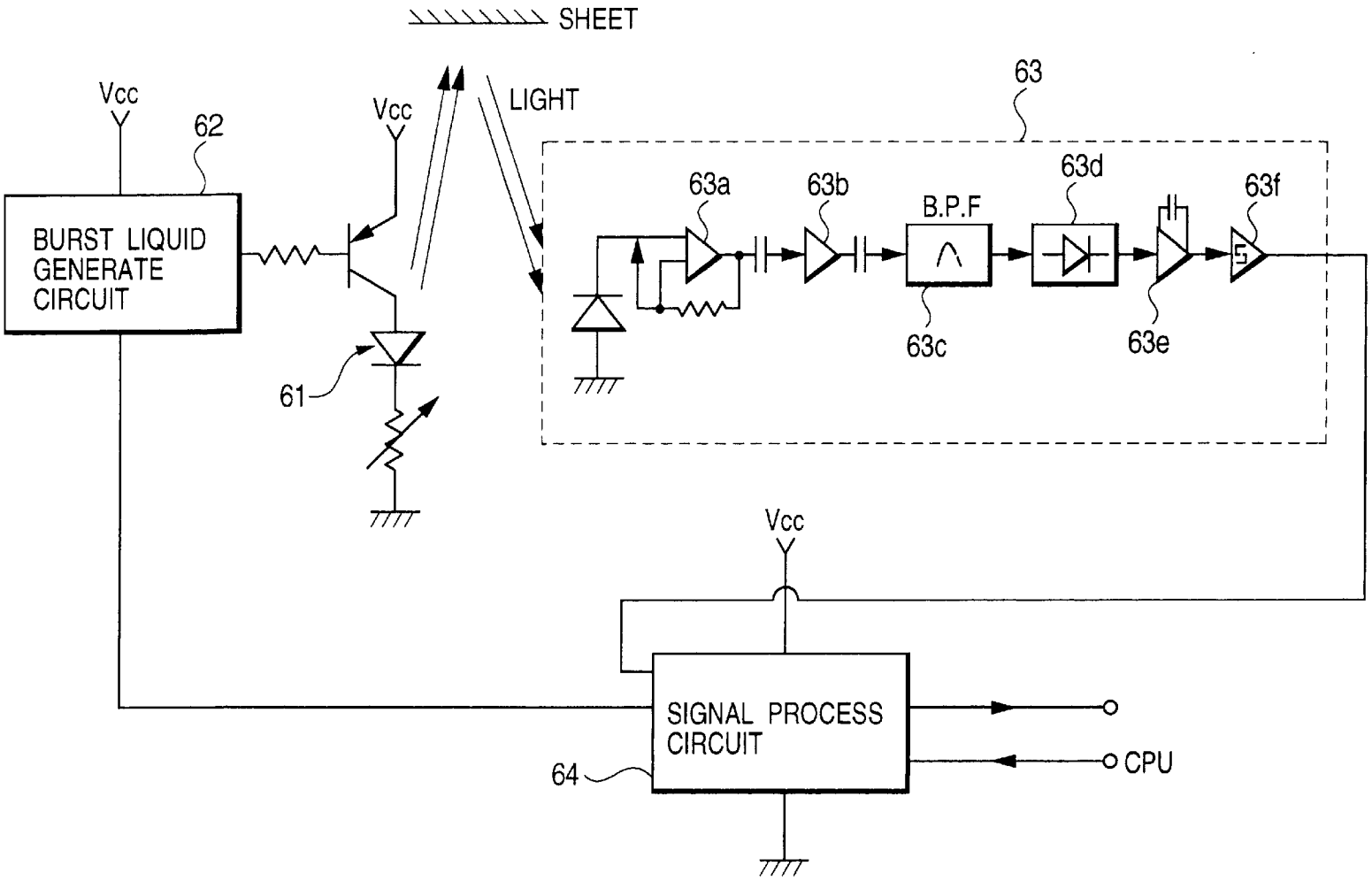
FIG. 11 is a block diagram of a distance measurement sensor of the sheet stacking apparatus.

FIG. 11 schematically shows a block diagram of the distance sensor 60. In FIG. 11, the reference numeral 61 denotes a light emitting element (LED) and 62 denotes a burst wave generate circuit for generating a signal for activating the light emitting element 61. The light emitting element 61 and the burst wave generate circuit 62 constitute the illumination portion. Further, the reference numeral 63 denotes a PSD (position sensitive detector) light receiving element for receiving the light reflected from the first, second or third tray 23, 24 or 25. The PSD light receiving element 63 comprises an amplifier 63*a*, a limiter 63*b*, a band pass filter (BPF) 63*c*, a demodulator 63*d*, an integrator 63*e* and a comparator 63*f* and serves to generate currents having different values in accordance with a light receiving position for the light reflected from the sheet. A signal process circuit 64 serves to output a trigger signal to the burst wave generate circuit 62 and to convert the current into voltage information.

Figure 12:
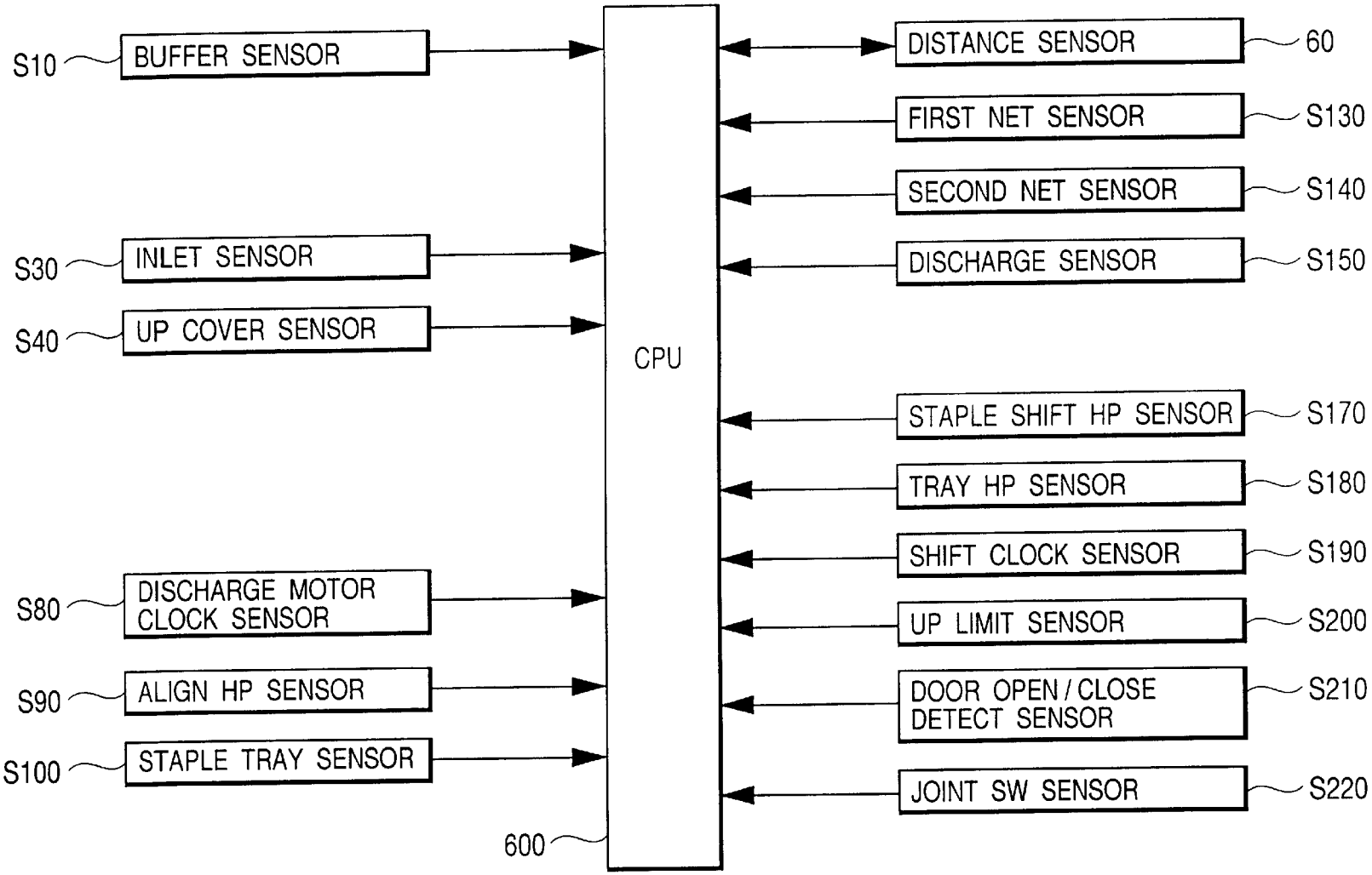
FIG. 12 is an explanatory view showing a portion of a block diagram of a CPU of the sheet stacking apparatus.
Figure 13:
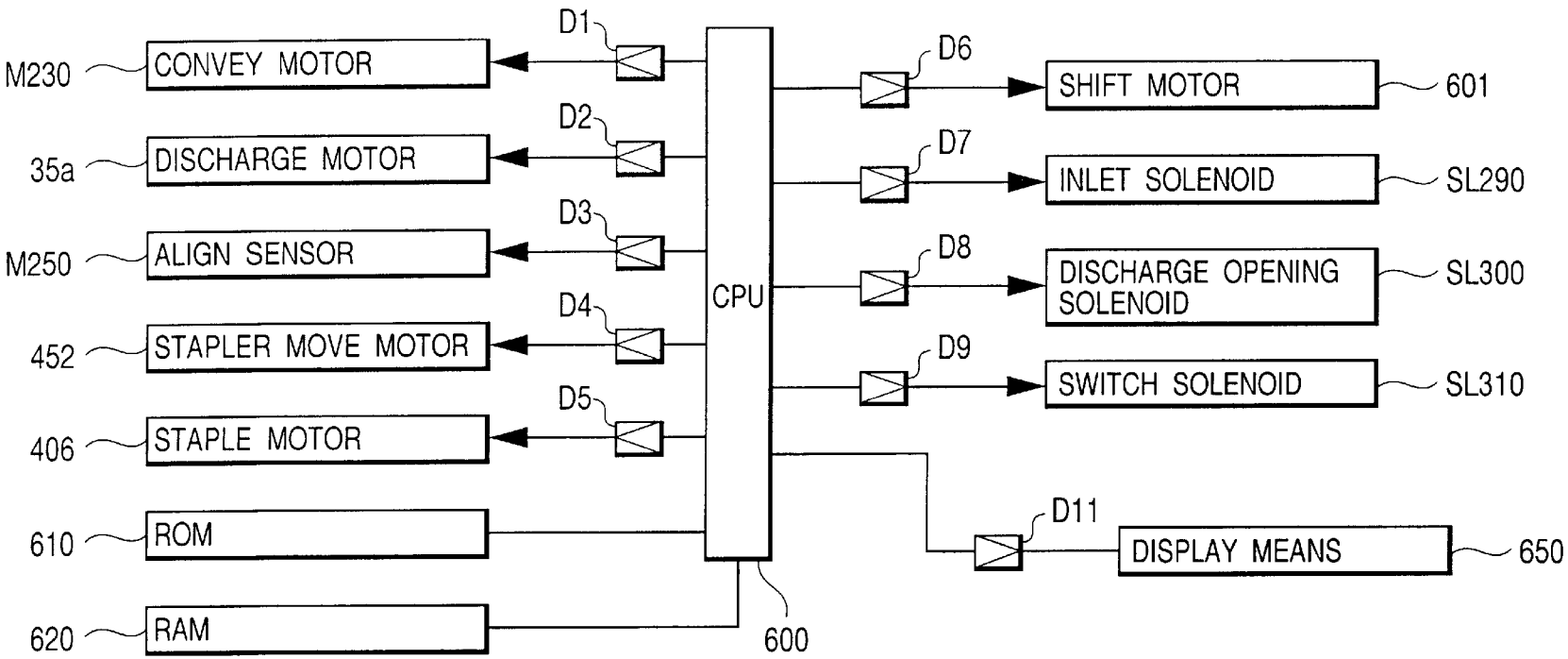
FIG. 13 is an explanatory view showing the other portion of the block diagram of the CPU of the sheet stacking apparatus.

As mentioned above, the distance sensor 60 is disposed within the sheet stacking apparatus 1 and is connected to the CPU 600 having block construction as shown in FIGS. 12 and 13 so that, when the signal is inputted from the CPU 600, it causes the burst wave generate circuit 62 to output a trigger signal to thereby illuminate the light emitting element 61 and it outputs the voltage information corresponding to the light receiving position for the light in the PSD light receiving element 63 to the CPU 600.

Figure 14:
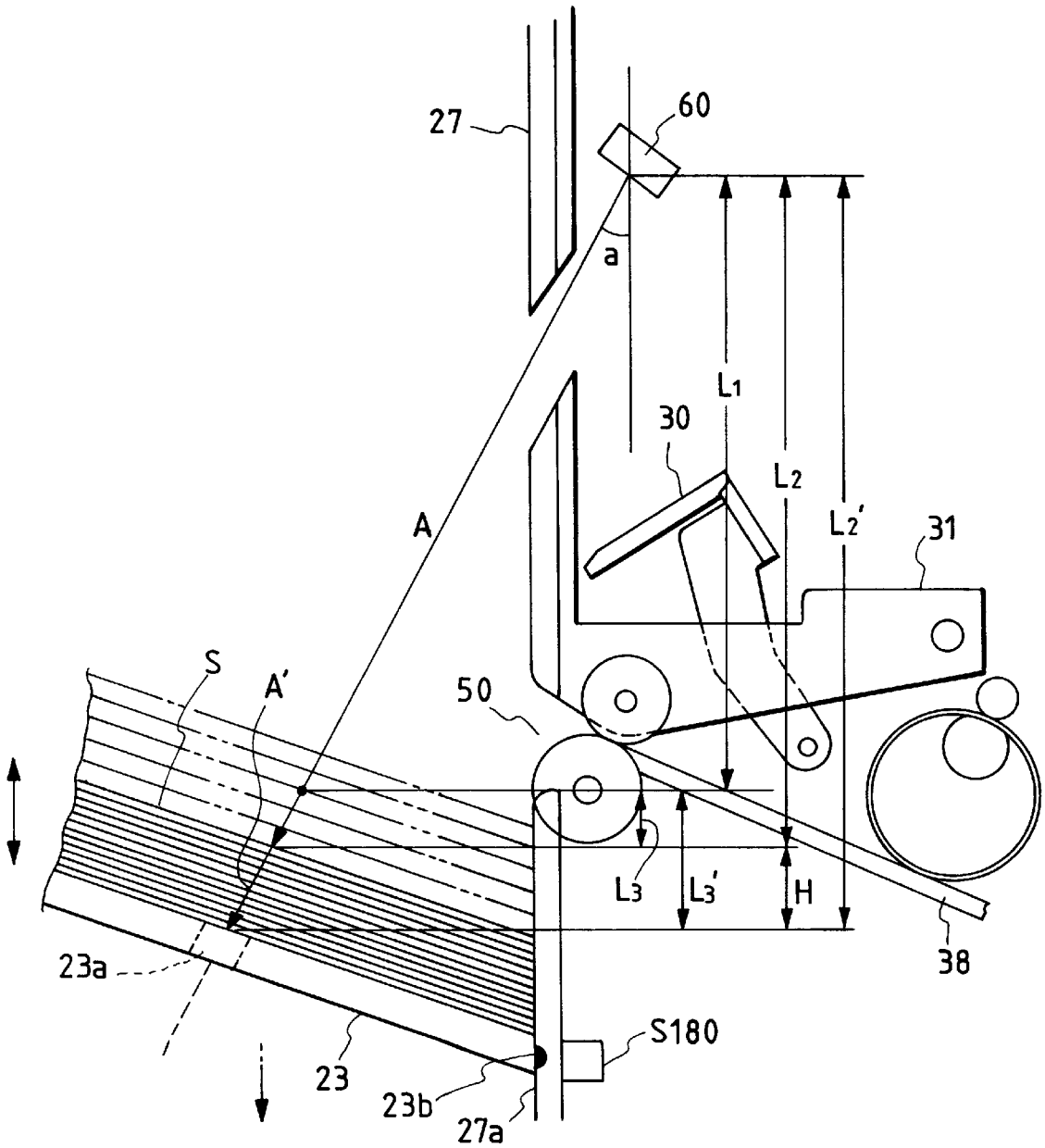
FIG. 14 is an explanatory view showing a distance measuring principle of the sheet stacking apparatus.

As shown in FIG. 14, the distance sensor 60 is disposed above the tray 23 and is inclined with respect to the tray by a predetermined angle a (30 degrees in the illustrated embodiment) so that the light is illuminated on the tray 23 (sheet S). On the other hand, the CPU 600 first determines the distance A between the distance sensor 60 and the upper surface of the sheet stack S on the tray 23 on the basis of magnitude of the voltage signal from the distance sensor 60. By determining the distance A or A' (A' is the distance when only a single sheet is rested on the tray) in this way, it is possible to determine the vertical distance L2 or L2' between the distance sensor 60 and the surface of the sheet stack on the basis of the following equations:

$$L2 = A \times \cos 30^\circ \quad (1)$$

$$L2' = A' \times \cos 30^\circ \quad (2)$$

Incidentally, the distance L2' indicates the vertical distance when the tray 23 is positioned at a position where the first sheet is discharged onto the tray.

Since the distance L1 between the distance sensor 60 and the discharge opening 50 already known, the distance (L3') between the tray 23 and the discharge opening 50 and the distance (L3) between the surface of the sheet stack and the discharge opening 50 can be determined on the basis of the following equations:

$$L3 = L2 - L1 \quad (3)$$

$$L3' = L2' - L1 \quad (4)$$

Figure 15:
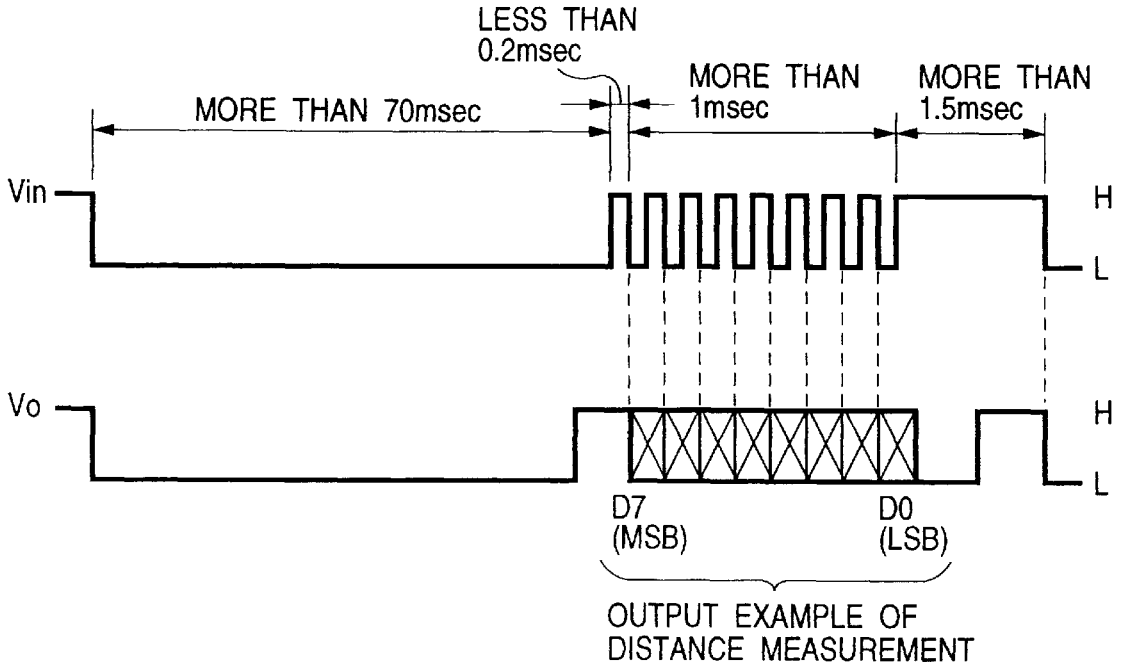
FIG. 15 is an explanatory view showing a signal outputted from the CPU to the distance measurement sensor and a signal inputted form the distance measurement sensor to the CPU.

By the way, such distance measurement is effected whenever the sheet discharge (single sheet discharge) or post-treatment (sheet bundle discharge) such as stapling is performed by the CPU 600, by intermittently inputting a signal as shown in FIG. 15 to the burst wave generate circuit 62 through the signal process circuit 64.

In FIG. 15, a signal Vin is a signal for illuminating the light, for example, during every stapling operation. When a low level L of the signal Vin continues longer than 70 msec, the light emitting element 61 starts to emit the light to start the measurement, and, thereafter, eight clock signals shorter than 0.2 msec are inputted to the burst wave generate circuit 62, for example, for 1 msec or more, thereby measuring the distance. The measurement is finished by providing a H (high level) signal longer than 1.5 msec after the eight clock signals have been inputted. Regarding the signals at the light emitting side, in the PSD light receiving element 63, the received reflected light is outputted to the CPU 600 as 8-bit voltage information.

On the other hand, in the CPU 600, 8-bit distance data which was previously sought by tests is stored in a table of a ROM (read only memory) 610 (FIG. 13) in which a control procedure to be executed by the CPU 600 is stored. On the basis of the table, the distance A between the distance sensor 60 and the sheet stack is determined in accordance with the data sent from the distance sensor 60.

For example, as shown in FIG. 14, the sheet stacking apparatus 1 is provided with a tray HP sensor (stacking plate position detection means) S180. By this sensor S180 and an actuator 23*b* of the tray 23 for activating the sensor S180, it is possible to detect a home position of the tray 23 and to detect a home position of the next tray 24 or 25 when the tray is shifted. By providing the sensor S180 in this way and by providing the actuators on the respective trays 23, 24 and 25, it is possible to detect the surfaces of the sheet stacks on the trays 23 to 25. With this arrangement, a plurality of trays can be positioned at any level.

The CPU 600 determines the height H of the sheet stack on the tray 23, 24 or 25 on the basis of the height position L2' of the tray when detected by the sensor S180, and the distance L2 between the distance sensor 60 and the sheet stack (on the tray 23, 24 or 25) determined by the distance sensor 60. The value L2' may be measured as mentioned above, or, may previously be clarified in case of the sheet bundle.

When the sheets are stacked by a predetermined amount, a shift motor 601 is driven through a driver D6 (FIG. 13) not to interfere with the discharge of the sheet, thereby shifting the tray unit 26 downwardly to lower the tray 23. In this way, the distance between the discharge opening 50 and the sheet stacking plate is maintained more than L3. As the sheets are successively stacked, when the sheet stacking height H exceeds a first predetermined height indicating the fact that a maximum amount of sheets are stacked on the tray 23, the tray unit 26 is shifted so that further sheets can be stacked on other tray.

In this way, by measuring the height of the sheet S or the distance between the sheet stacking surface and the discharge opening 50, it is possible to calculate the proper shifting amount of the tray 23. Incidentally, the calculated result is stored in a RAM (random access memory) 620 for storing various data.

The first, second and third trays 23, 24 and 25 are provided with through holes 23*a*, 24*a* and 25*a* (FIGS. 2 and 14) at measuring points for the distance sensor 60, so that the presence/absence of the sheet on the trays 23 to 25 can be detected. That is to say, when the light is emitted toward the trays, if no sheet is rested on the trays 23 to 25, the illumination light passes through the through holes 23*a*, 24*a*, 25*a* to reach, for example, a lowermost tray and is reflected by the sheet on the lowermost tray. With this arrangement, the sheet stacking height determined in this case normally becomes greater than a second predetermined height indicating the fact that the tray is positioned at a position where the first sheet is discharged on the tray, with the result that the CPU 600 can determine that there is no sheet on the trays 23 to 25.

Incidentally, after it was determined that there is no sheet on the trays 23, 24 and 25, the CPU 600 determines that the trays 23 to 25 are in a sheet stackable condition and discharges the first sheets on the trays 23 to 25.

In addition to the distance sensor 60, as shown in FIG. 12, a buffer sensor (detection means) S10 for detecting the fact that the sheet is trapped in the sheet stacking apparatus, an inlet sensor S30 for detecting the fact that the sheet discharged from the copying machine 100 enters into the sheet stacking apparatus 1, an UP cover sensor S40 for detecting the fact that an upper cover of the sheet stacking apparatus 1 is opened, a discharge motor clock sensor S80 for sending information regarding speed control or abnormality of the discharge motor 35*a* when the sheets are discharged from the sheet stacking apparatus 1 onto the trays 23, 24 and 25, an align HP sensor S90 for detecting the abutment plate 20 in the stapling operation, and a staple tray sensor S100 for detecting presence/absence of the sheet on the staple tray 38 are electrically connected to the input side of the CPU 600.

Further, first and second net sensors S130 and S140 for detecting positions of the upper and lower net guides 27 and 27*a* forming upper and lower walls of the discharge opening 50, a discharge sensor S150 for detecting the fact that the sheet is discharged from the sheet stacking apparatus 1 onto the tray, a staple shift HP sensor S170 for detecting the fact that the stapler 400 shiftable within the sheet stacking apparatus 1 is positioned at the home position, a shift clock sensor S190 for informing the CPU 600 of a shifted amount of the shiftable tray or abnormality of the shift motor as a drive source for the tray, an UP limit detection sensor S200 for detecting an upper limit of the shiftable tray, a door open/close detection sensor S210, and a joint SW sensor S220 for detecting the fact that the sheet stacking apparatus 1 is connected to the copying machine 100 are electrically connected to the input side of the CPU 600.

In addition to the shift motor 601, as shown in FIG. 13, a convey motor M230 for conveying the sheet in the sheet stacking apparatus, a discharge motor 35*a*, an align motor M250 for aligning the sheet, a staple move motor (pulse motor) 452 for shifting the stapler 400, a staple motor 406 for causing the stapler 400 to effect the stapling operation to staple the sheet bundle, an inlet solenoid SL290 for switching or changing the convey path for the sheet discharged from the copying machine 100, a discharge opening solenoid SL300 for switching or changing the discharge opening for the sheet discharged from the copying machine 100, a switch solenoid S1310 for switching the sheet convey path in the sheet stacking apparatus 1, and a display means 650 for informing the operator of alarm when the over-stacking is detected in the sheet stacking surface distance measurement are electrically connected to the output side of the CPU 600.

In the illustrated embodiment, the copying machine 100 is of digital type comprising a scanner portion for reading the image on the original and a printer portion for reproducing the image which can be operated independently. That is to say, in the scanner portion, the original is illuminated by a lamp, and the reflected light is decomposed to small spots (pixels) by a light receiving element, which small spots are converted into electric signals corresponding to light/shade of the image; whereas, in the printer portion, laser beams are projected onto the photosensitive drum in response to the electric signals, thereby forming an electrostatic latent image on the drum, and a copy image is formed on the sheet through developing, transferring and fixing processes.

Accordingly, by connecting an interface 500 to the digital copying machine as shown in FIG. 1, the signals of the image read in the scanner portion can be transmitted to a facsimile 501, or, signals from the facsimile 501 can be transmitted to the printer portion through the interface 500, thereby copying the image on the transfer sheet. Similarly, signals from a computer equipment 502 such as a personal computer can be transmitted to the printer portion through the interface 500, thereby copying the image on the transfer sheet, or, the image read in the scanner portion can be transmitted to the personal computer through the interface 500.

As mentioned above, in present digital copying machines, not only the original sent from the ADF 300 or the original rested on the original platen glass can be read to obtain the copy, but also the copying machine can be used as a facsimile or a printer of a personal computer by using the interface 500. Next, the sheet stacking control of the CPU 600 of the sheet stacking apparatus 1 connected to the digital copying machine will be explained with reference to flow charts shown in FIGS. 16, 17 and 18.

Figure 16:
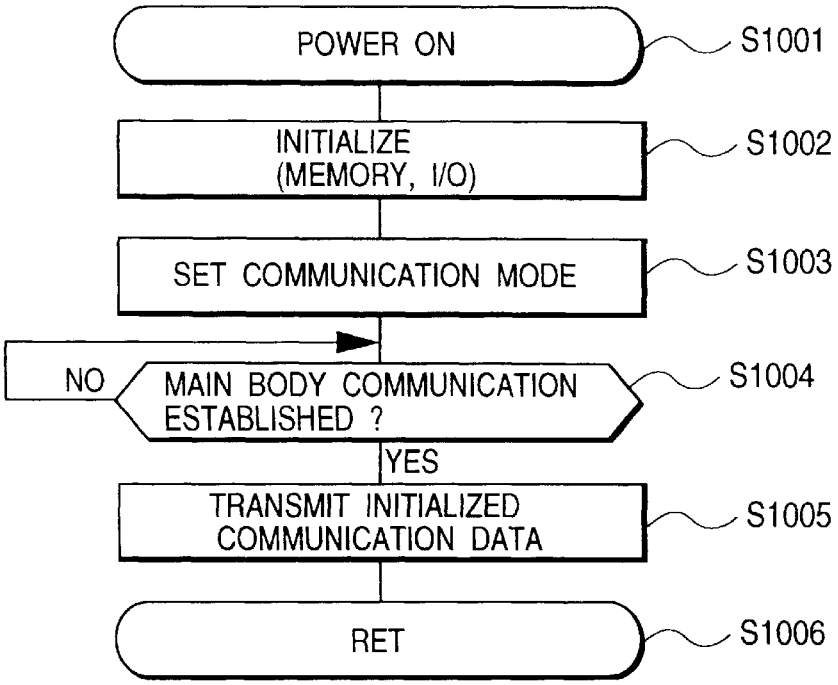
FIG. 16 is a flow chart showing a portion of a control operation of the CPU.

In FIG. 16 showing a flow chart for effecting initialization of the sheet stacking apparatus 1, when an electric power source is turned ON in a step S1001, in a step S1002, I/O ports and memory (RAM) are initialized. Then, in a step S1003, a communication mode (to FAX, printer, copying machine) is set, and, in a step S1004, it is determined whether the communication to the main body of the copying machine is established. If affirmative, in a step S1005, initializing communication data (sheet stacking apparatus stand-by signal) is emitted from the sheet stacking apparatus 1.

Figure 17:
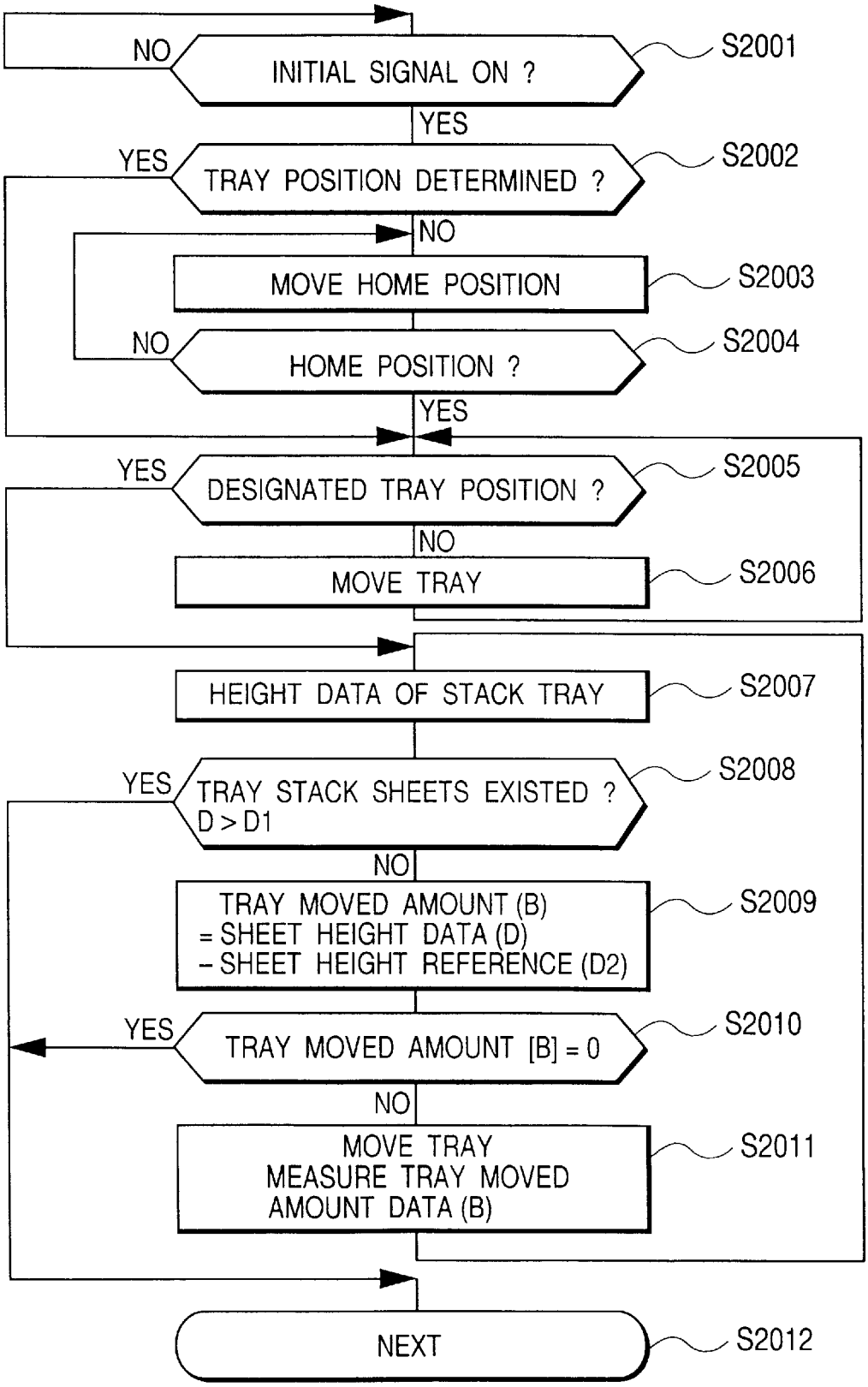
FIG. 17 is a flow chart showing another portion of the control operation of the CPU.

On the other hand, after the initializing communication data is emitted, in FIG. 17 showing a flow chart for effecting the tray position control, when an operation start signal is sent to the sheet stacking apparatus 1, in a step S2001, it is determined whether an initial signal (operation start signal) indicating the fact that the sheet stacking apparatus 1 was initialized is turned ON. If ON, in a step S2002, it is determined whether a tray position is determined. If the tray position is not determined, in a step S2003, the tray is shifted to the home position.

Then, in a step S2004, it is determined whether the tray has been shifted to the home position. If affirmative, the program goes to a step S2005. In the step S2002, if it is determined that the tray position is determined, the program also goes to the step S2005, where it is judged whether the present tray is positioned at a tray designated position. If affirmative (the designated position), the program goes to a step S2007; whereas, if negative, the program goes to a step S2006, where the tray is shifted to the designated position.

After the tray was shifted to the designated position in the step S2006, in the step S2007, the sheet stacking height on the tray (referred to as "tray stacking height" hereinafter) is measured by the distance sensor 60. Then, the program goes to a step S2008, tray stacking height data D measured in the step S2007 is compared with sheet height reference data D1 corresponding to the second predetermined height. In this case, if there is no sheet on the tray, since the through hole is not closed by the sheet, the tray stacking height data D becomes greater than the reference data D1. In this case, it is determined that there is not sheet on the tray, and the program goes to a step S2012, where the first sheet is discharged on the tray maintaining the present tray height.

On the other hand, if D1>D, the program goes to a step S2009, where tray shift amount data B is determined on the basis of a difference between the tray stacking height data D and the sheet height reference data D2 corresponding to the predetermined height, and, in a step S2010, it is determined whether the tray shift amount data B is zero (i.e., the present sheet height is a maximum stacking amount). If affirmative, the program goes to the step S2012. On the other hand, if the present sheet height does not reach the maximum stacking amount, the program goes to a step S2011, where the tray is shifted by a distance corresponding to the tray shift amount data B. Then, the program is returned to the step S2007, where the tray stacking height data D is measured again, and, after the tray is shifted to the predetermined height, the program goes to the step S2012. In this way, by determining the sheet stacking height by the distance sensor 60 and the sensor S180 at a predetermined timing after the post-treatment, the position control of the trays can be properly effected without interference from the distance sensor 60.

Figure 18:
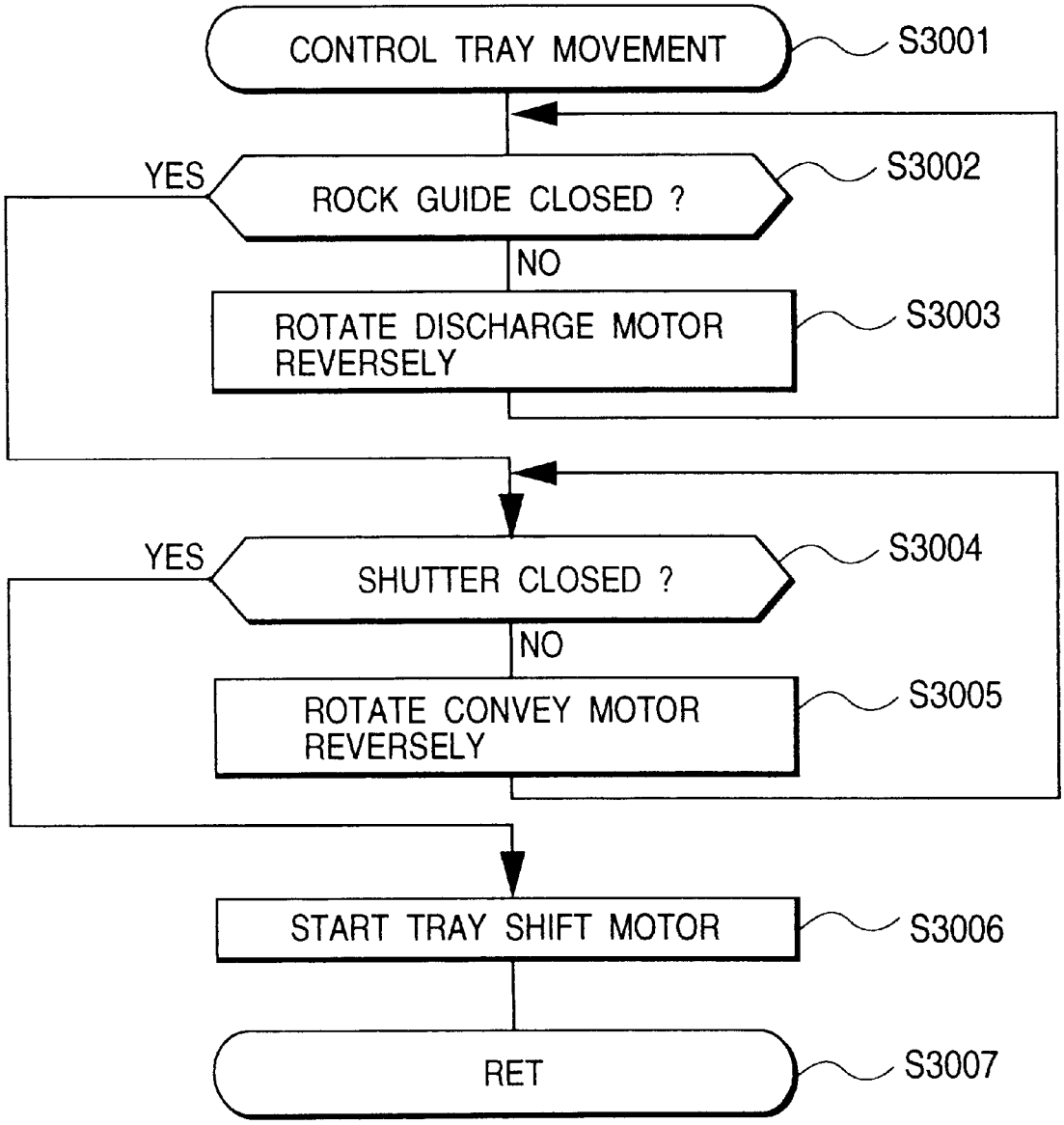
FIG. 18 is a flow chart showing a further portion of the control operation of the CPU.

In FIG. 18 showing a flow chart for effecting the tray movement control, in a step S3002, it is judged whether the rockable guide is closed. If the rockable guide is opened, in a step S3003, the discharge motor 35*a* is rotated in a reverse direction until the rockable guide 31 is closed. When the rockable guide 31 is closed, or if the rockable guide 31 is initially closed, the program goes to a step S3004, where it is judged whether the stopper 30 is closed. If the stopper 30 is closed, the program goes to a step S3006, where the shift motor 601 is driven.

Figure 19:
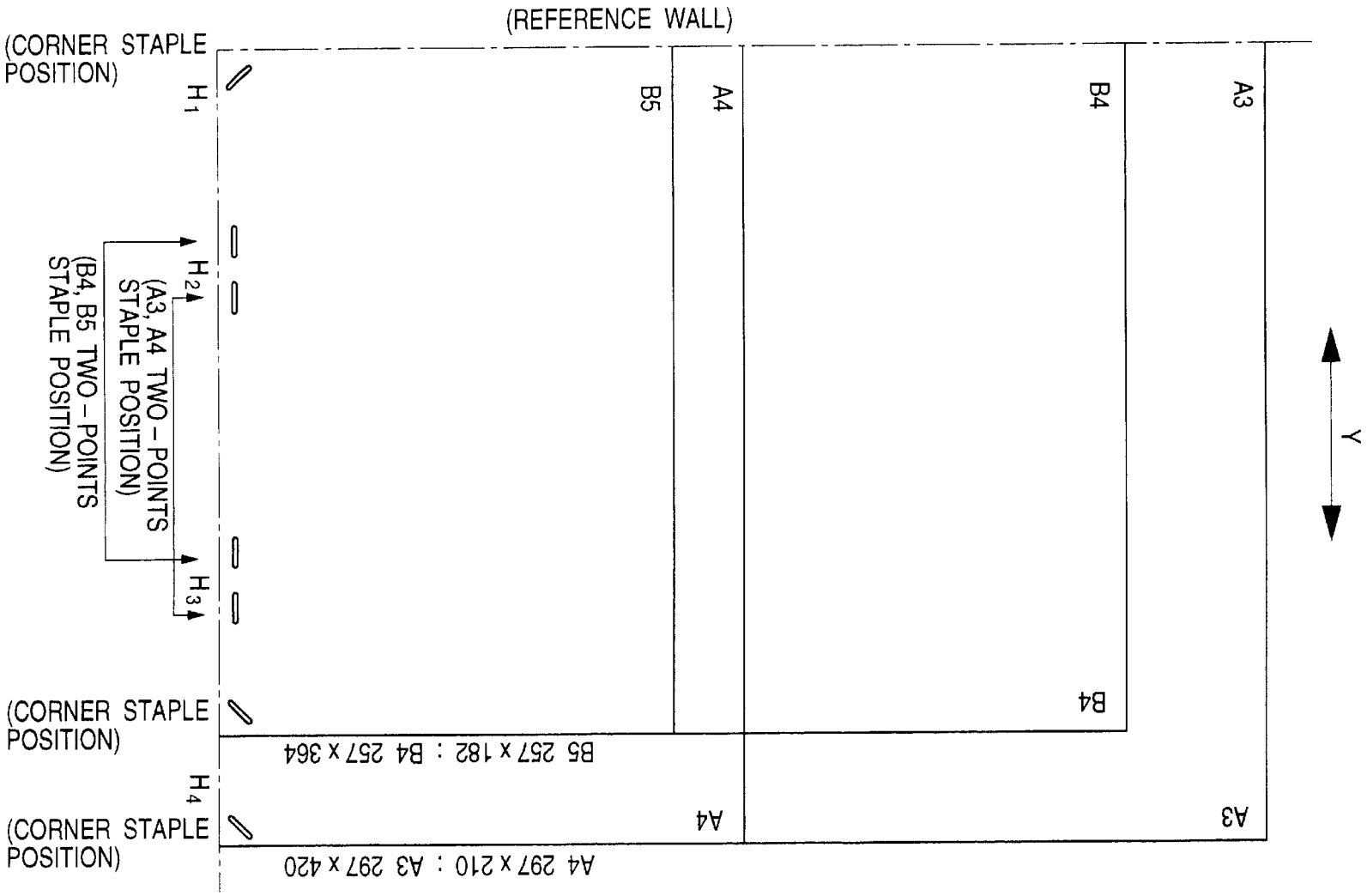
FIG. 19 is an explanatory view for staple positions of a staple unit of the sheet stacking apparatus.

In FIG. 2, a stapler unit 400A includes the stapler 400 for effecting the stapling operation regarding the sheet stack (sheet bundle) rested on the staple tray 38. As shown in FIG. 19, the staple unit is shifted in a direction shown by the arrow Y by means of a pulse motor (described later) so as to effect front one-point staple (staple position $H_1$), intermediate two-points staple (staple positions $H_2$, $H_3$) and rear one-point staple (staple position $H_4$) regarding the sheet bundle rested on the staple tray 38.

Incidentally, in FIG. 19, while an example that the sizes of the sheets to be stapled are A3, A4, B4 and B5 is shown, the present invention is not limited to such sizes of the sheets.

Figure 20:
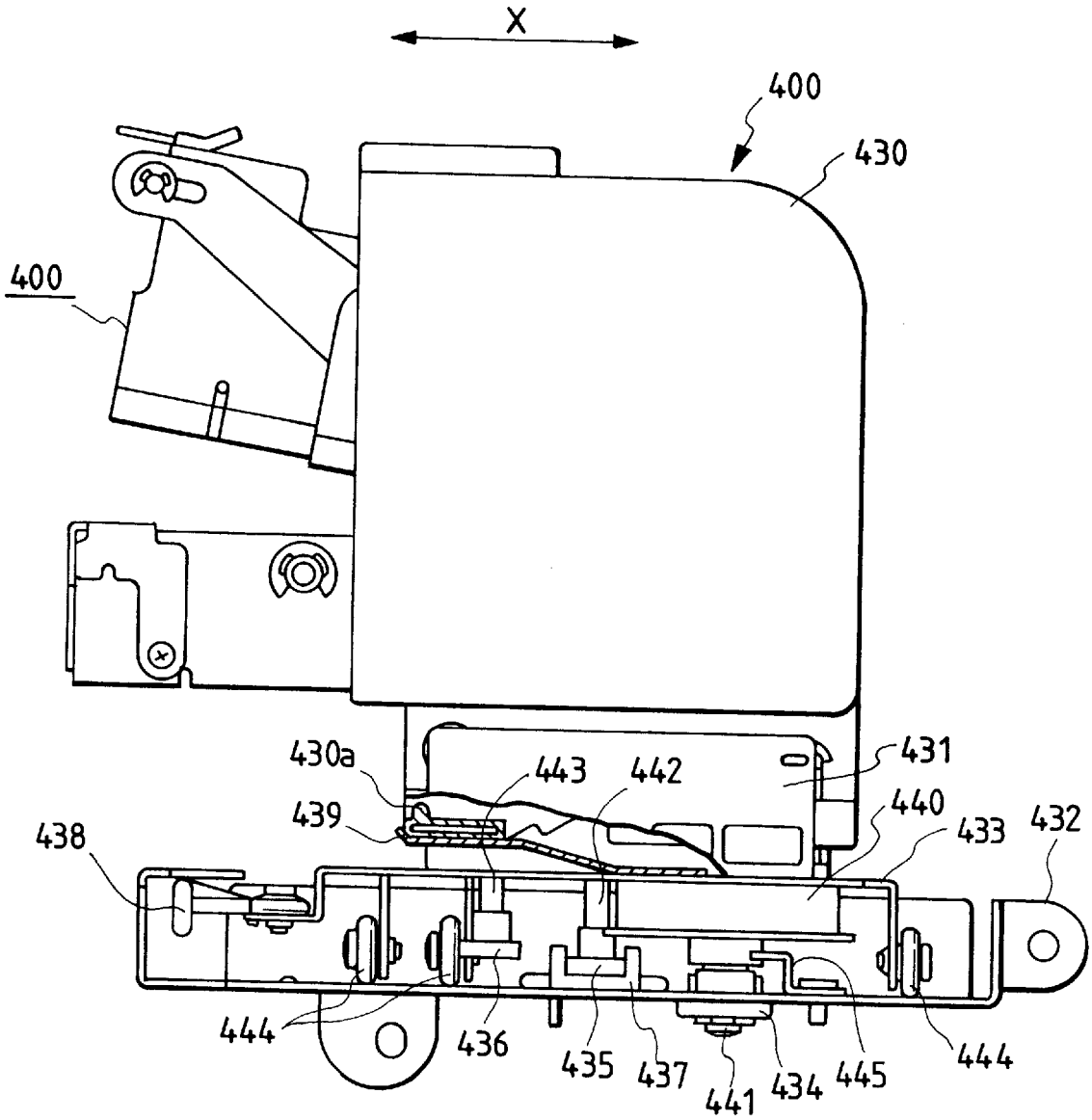
FIG. 20 is a partial side sectional view of the staple unit.

As shown in FIG. 20, the staple 400 is secured to a staple cover 430 and is supported for shifting movement in a direction shown by the arrow X by means of a support member 431 secured to a shift table 433. A spring member 439 is secured to the shift table 433 so that the staple cover 430 is biased upwardly by the spring member 439 and is positioned by a stopper 430*a*. Further, support shafts 441, 442, 443 are secured to the shift table 433. A pulley gear 440 is rotatably supported on the support shaft 441, and guide support members 434, 435, 436 are rotatably supported on the support shafts 441, 442, 443, respectively. Further, rollers 444 for permitting parallel movement of the shift table 433 are rotatably supported on the shift table 433, and a stopper regulating member 438 constituting a retard means (described later) for the abutment member 20 is secured to the shift table.

Figure 21:
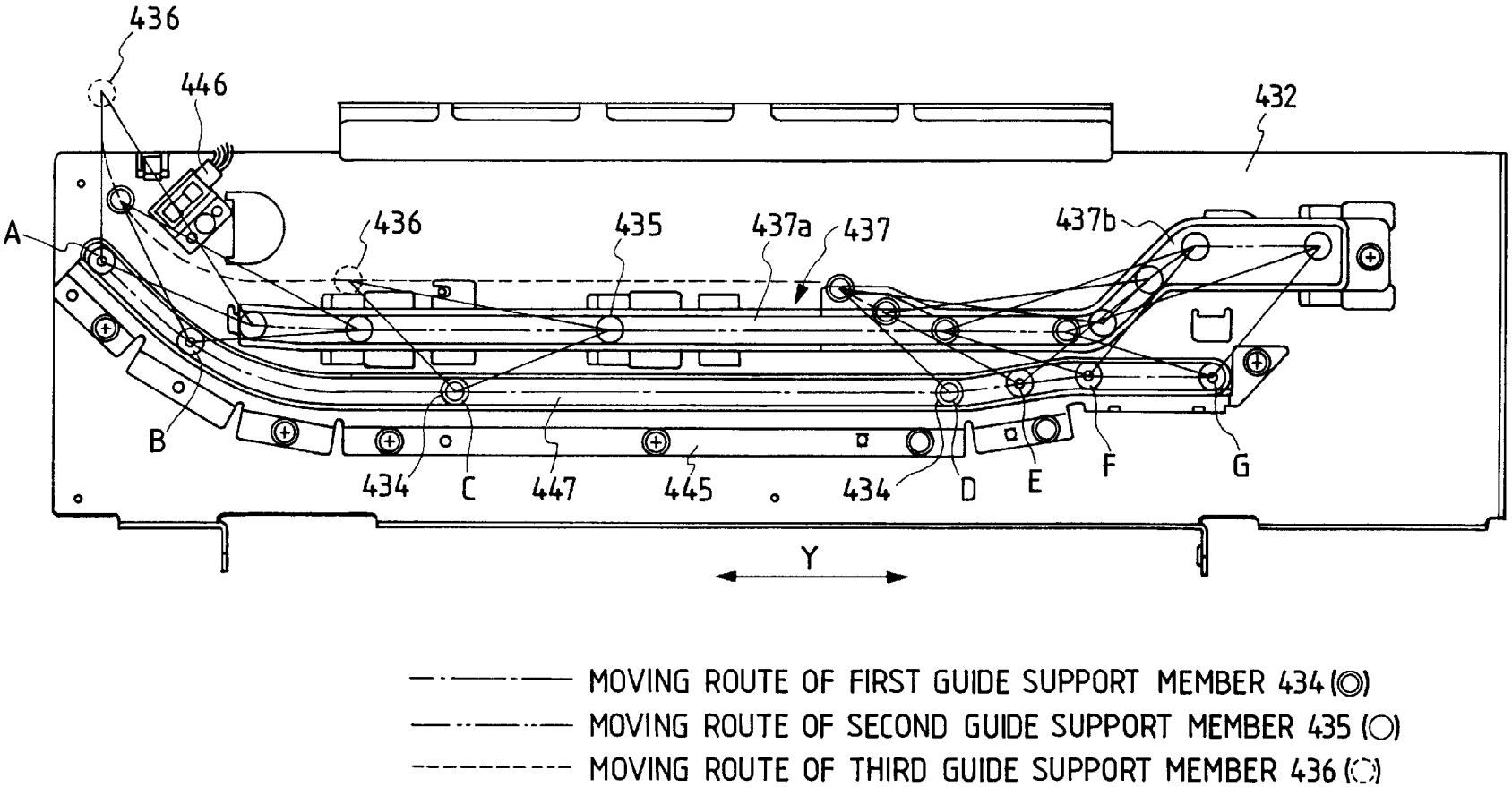
FIG. 21 is a schematic plan view showing moving routes of the staple unit.

On the other hand, as shown in FIG. 21, a stay 432 opposed to the staple tray 38 is provided with an elongated slot 447 for regulating the movement of the first guide support member 434, a rail 437 for regulating movements of the second and third guide support members 435, 436, and a fixed rack gear 445 meshed with the pulley gear 440. In FIG. 21, a photo-interrupter 446 serves to detect whether the staple unit 400A is positioned at its home position (where the first guide support member 434 is positioned at a position shown by "A" in FIG. 21). By determining a rotational amount of the pulse motor (described later) from the home position on the basis of the number of pulses, the staple position of the staple unit 400A is controlled. Incidentally, the present invention is not limited to such an arrangement.

Figure 22:
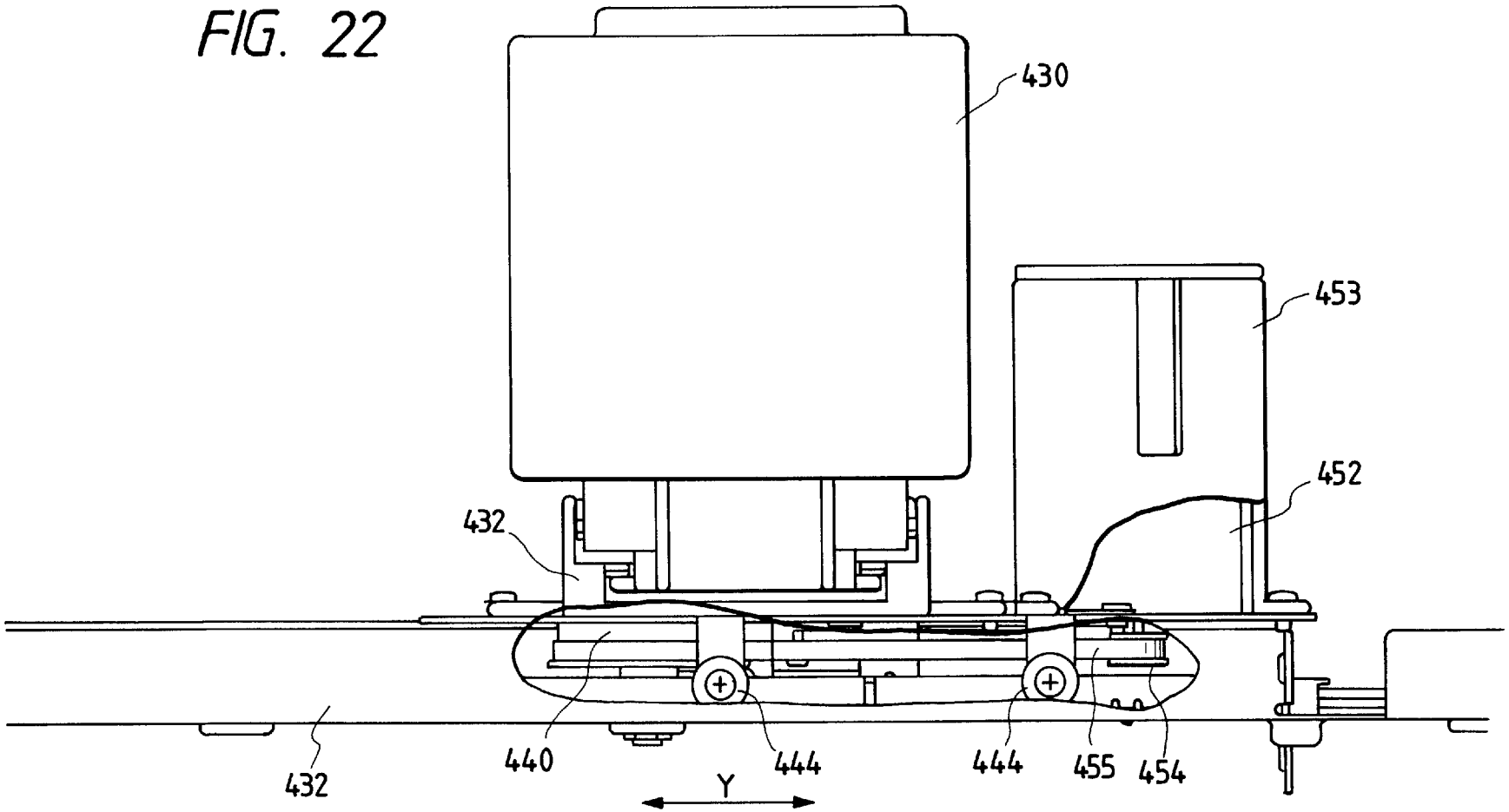
FIG. 22 is a partial right side sectional view of the staple unit.

Further, as shown in FIG. 22, a pulse motor 452 for shifting the staple unit 400A in a direction shown by the arrow Y is secured to the shift table 433, and a belt pulley 454 is secured to an output shaft of the pulse motor. The belt pulley 454 is connected to the pulley gear 440 via a timing belt 455, so that rotation of the motor 452 is transmitted to the pulley gear 440 through the belt pulley 454 and timing belt 455, with the result that the staple unit 400A is shifted in the direction Y. Incidentally, the reference numeral 453 denotes a cover for electric parts such as the pulse motor 452 and the like.

When the staple unit 400A is shifted, the first guide support member 434 is shifted between positions A–E shown in FIG. 21 along the elongated slot 447 of the stay 432. On the other hand, the second guide support member 435 is shifted along the rail 437 while the first guide support member 434 is being shifted between the positions A–E, and the third guide support member 436 is shifted along the rail 437 while the first guide support member 434 is being shifted between positions E–G.

For example, in FIG. 21, when the first guide support member 434 is positioned at the position A, the position of the second guide support member 435 is regulated by the rail 437 and the third guide support member 436 is in a free condition. In this case, corner stapling at the staple position $H_1$ is permitted. Further, when the first guide support member 434 is shifted from the position A to the position C, the staple unit 400A inclined at a predetermined angle at the position A is rotated so that it is gradually brought to a horizontal position in the width-wise direction of the sheet by shifting the second guide support member 345 along the rail 437. Also, while the first guide support member 434 is being shifted from the position C to a position D, the position of the staple unit 400A is controlled so that it is maintained in the horizontal condition. As a result, the parallel two-points staple ($H_2$, $H_3$) can be performed in accordance with the size of the sheet.

In this way, the staple unit 400A can be shifted in the direction Y while regulating the position and the inclination angle of the staple unit by means of two of three guide support members 434, 435 and 436. Thus, the front one-point staple and two-points staple can be effected regarding the sheets having various sizes. Incidentally, the shift amount of the first guide support member 434 is defined by the rotational amount of the pulse motor 452 as mentioned above.

Further, in the illustrated embodiment, as shown in FIG. 3, by providing the sheet align reference plate 29 at only one side, while the front one-point staple position ($H_1$) was common to the sheets having various sizes, the present invention can be applied to a case where a sheet align reference is constituted by a sheet sensor and two-point staple positions ($H_2$, $H_3$) are common to sheets having various sizes.

When such stapling operation is performed, it is necessary to provide a regulating member against which trail ends of the sheets abut to align the sheet bundle. To this end, the abutment plate 20 is provided at the rear end of the staple tray 38. The abutment plate 20 is rotatably held by a shaft member 457 secured to the staple tray 38 and is biased toward an anti-clockwise direction by a spring member 448 mounted around the shaft member 457 so that a regulating portion 20*a* formed at one end of the abutment plate is protruded upwardly from a rear end of the staple tray 38. In this condition, when the sheets are stacked on the staple tray 38, the trail ends of the sheets abut against the abutment plate 20, thereby aligning the trail end of the sheet bundle.

Since the abutment plate 20 is overlapped with the stapler 400, when the staple unit 400A is shifted or when the stapling operation is performed, the abutment plate 20 becomes an obstacle. In this regard, the abutment plate 20 is provided with a retard means 449 for retarding the abutment plate 20 to a retard position where the abutment plate does not interfere with the movement of the staple unit 400A when the latter is shifted. The retard means 449 comprises a gear portion 450 secured to the abutment plate 20 and attached to the shaft member 457, a rotatable sector gear 451 having a rotatably supported lower end and meshed with the gear portion 450 of the abutment plate 20, and a stopper regulating member 438 secured to the shift table 433 and adapted to abut against the sector gear 451 and rotate the latter around a shaft portion 456 when the staple unit 400A is shifted.

Incidentally, the sector gear 451 is provided with an abutment portion 451*a*. When the staple unit 400A is shifted, the stopper regulating member 438 abuts against the abutment portion 451*a*, with the result that the sector gear 451 is pushed in a direction perpendicular to a shifting direction of the staple unit 400A, thereby rotating the sector gear to a position shown by the broken line. When the sector gear 451 is rotated in this way, the gear portion 450 meshed with the sector gear 451 is rotated, with the result that the abutment plate 20 is rotated downwardly around the shaft member 457 to the retard position (below the staple tray 38) where the abutment plate does not interfere with the movement of the staple unit 400A, while compressing the spring member 448.

Figure 23:
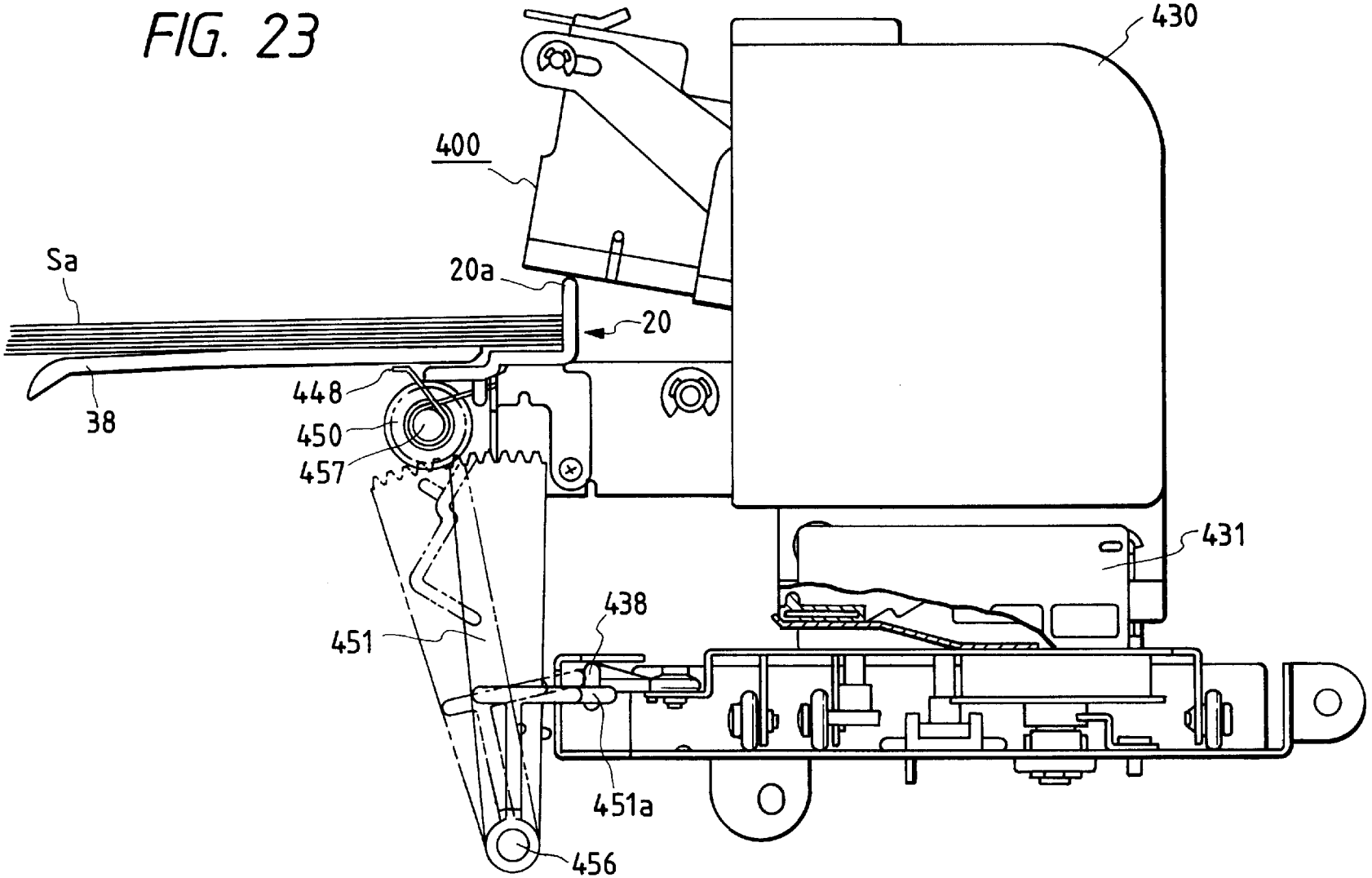
FIG. 23 is an explanatory view showing an operation of a retard means of the staple unit.
Figure 24:
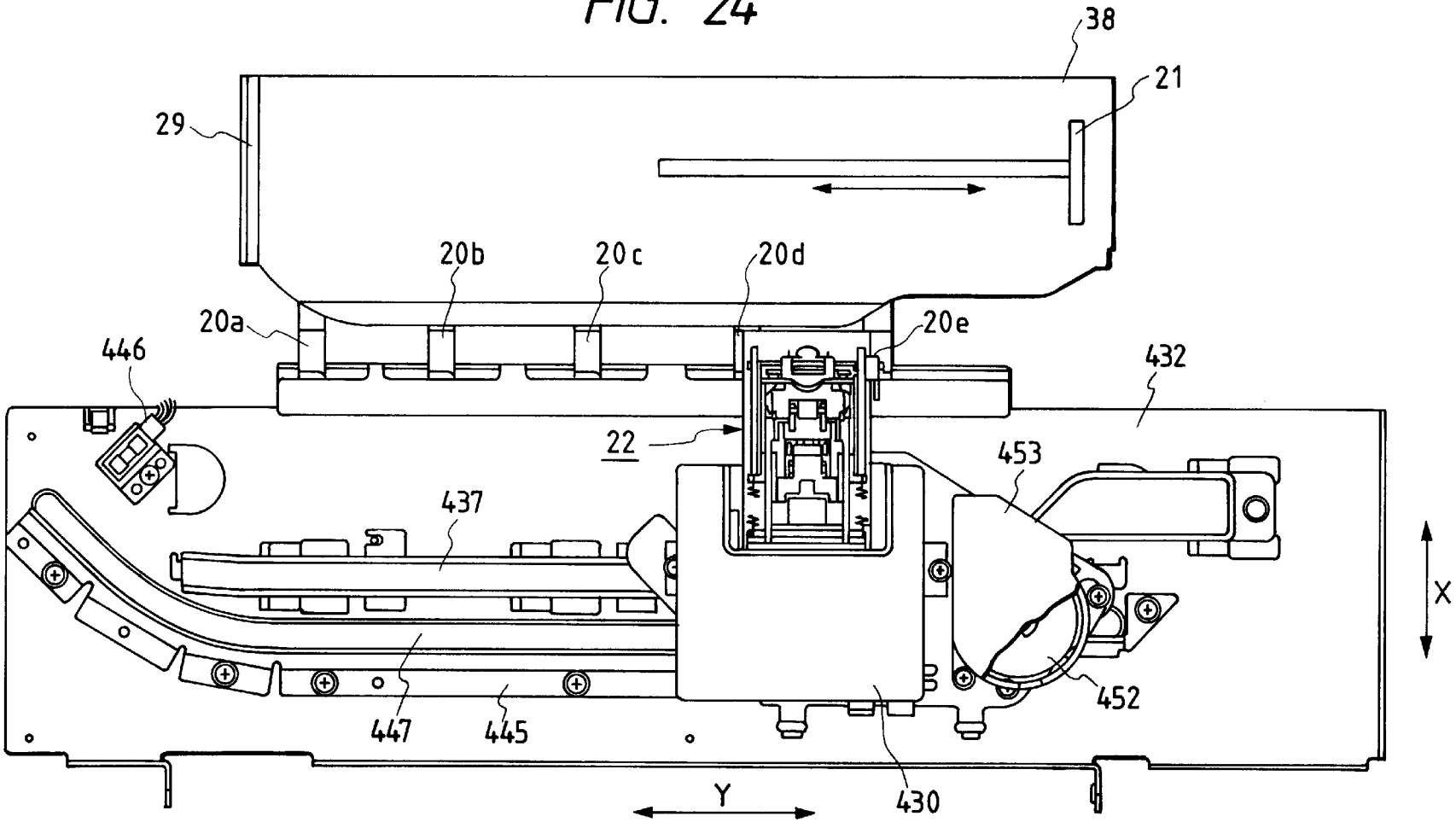
FIG. 24 is an explanatory view showing operations of the staple unit and an abutment member.

When the staple unit 400A is further shifted, since the stopper regulating member 438 is disengaged from the abutment portion 451*a* of the sector gear 451, under the action of the returning force of the spring member 448, the abutment plate 20 is returned, together with the sector gear 451, to a position where the trail end of the sheet bundle Sa is regulated (FIG. 23). As shown in FIG. 24, there are provided a plurality of abutment plates 20 in a width-wise direction of the sheets. Each of the abutment plates 20*a*, 20*b*, 20*c*, 20*d* and 20*e* has the retard means 449, and the abutment plates 20*a* to 20*e* can be rotated independently.

Incidentally, in FIG. 24, in accordance with the position of the staple unit 400A, three abutment plates 20*a*, 20*b*, 20*c* are positioned at a position where the trail end of the sheet bundle is aligned by these abutment plates, and the other two abutment plates 20*d* and 20*e* are positioned at the retard position where these abutment plates do not interfere with the movement of the staple unit 400A.

Figure 25:
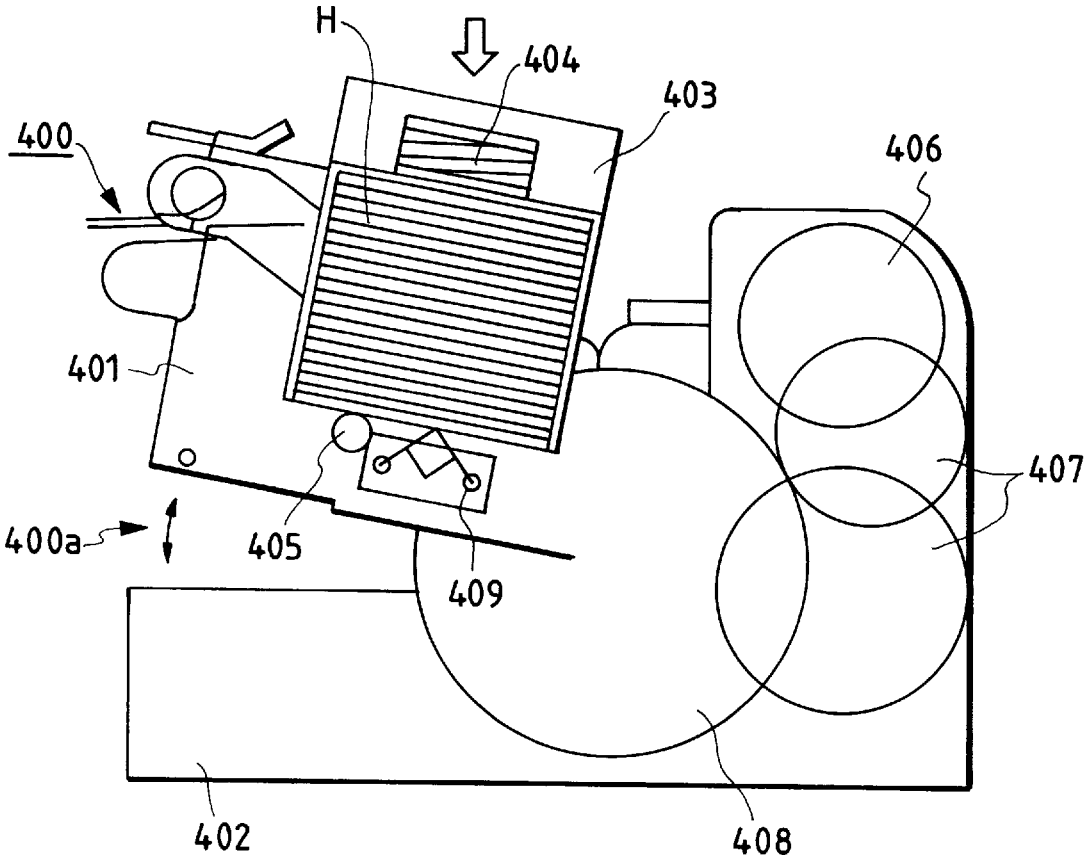
FIG. 25 is an explanatory view showing a structure of a stapler of the staple unit.

Next, a concrete construction and a fundamental operation of the stapler 400 will be explained. As shown in FIG. 25, the stapler 400 has a jaw structure and includes a needle stapling portion 400*a* comprised of an upper forming portion 401 and a lower staple table 402. A needle cartridge 403 is removably mounted on the forming portion 401, and about 5000 needles H connected to each other to form a plate shape are contained in the needle cartridge 403.

The needle plate H contained in the needle cartridge 403 is biased downwardly by a spring 404 provided within an upper portion of the needle cartridge 403 to afford a conveying force to a lower feed roller 405. The needle H fed out by the feed roller 405 is formed in a U-shape by rocking the forming portion 401. When the staple motor 406 is driven, the forming portion 401 is rocked toward the staple table 402 as shown by the arrow to effect a clinching operation (stapling operation) under an eccentric cam integrally attached to an eccentric cam gear 408 by rotating the eccentric cam gear 408 through a gear train 407.

Incidentally, the stapler 400 is provided with a sensor 409 of reflection type disposed below the needle cartridge 403 and adapted to detect absence of the staple needle H in the needle cartridge 403. The needle jam of the staple needle H fed out from the needle cartridge 403 can be detected by the sensor 409 of reflection type.

Figure 26:
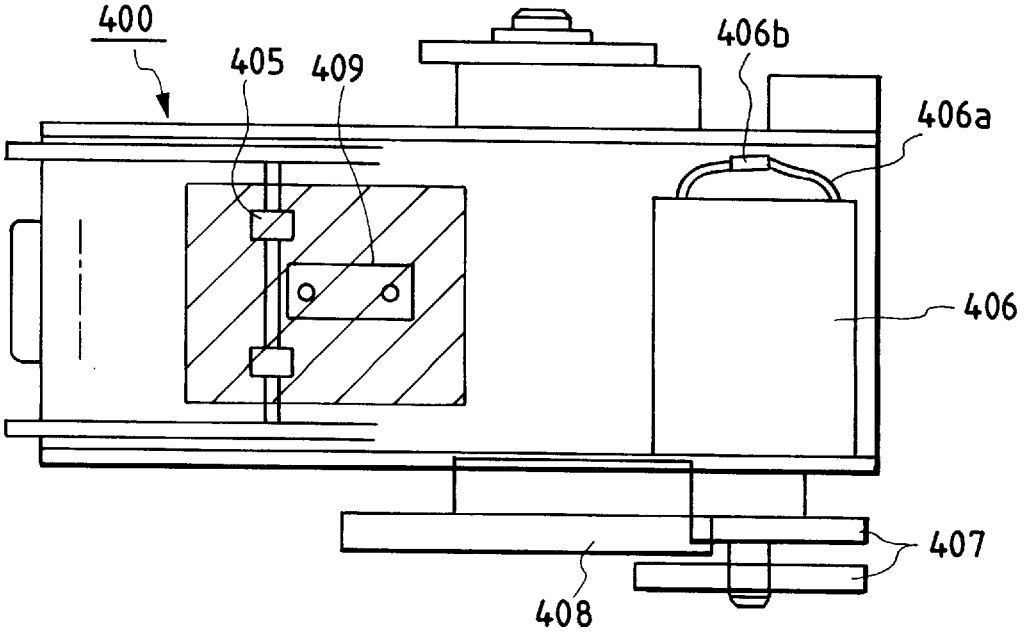
FIG. 26 is a plan view of the stapler.

Next, the staple needle jam detection will be explained. FIG. 26 is a plan view of the stapler 400. In FIG. 26, a cord 406*a* for feeding drive current is connected to the staple motor 406 and this cord 406*a* has a current sensor or load detection means (abnormality detection means) 406*b* for detecting a current value flowing in the cord.

Figure 27:
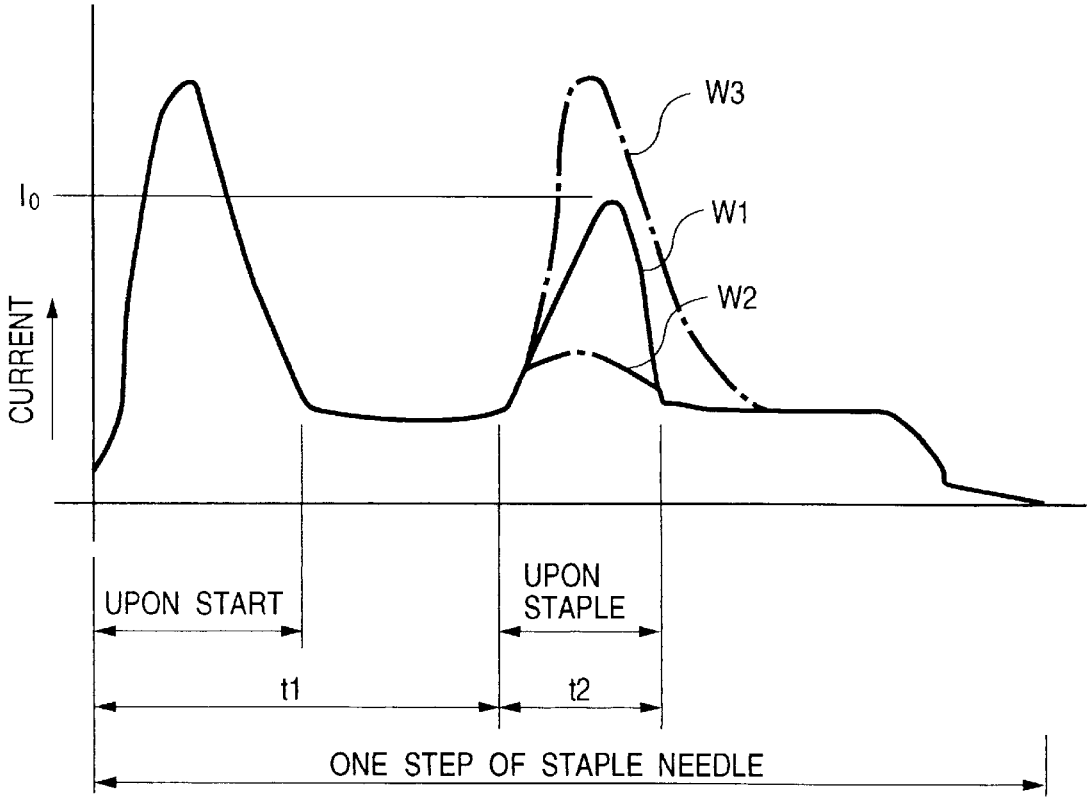
FIG. 27 is a view showing a wave form applied to a stapler motor in a stapling operation of the stapler.

On the other hand, FIG. 27 shows a wave form of the current value flowing in the staple motor 406 (at one stapling process) detected by the current sensor 406*b*. In FIG. 27, W1 indicates a wave form when the needle H is normally penetrates through the sheet bundle S and is bent, and W2 indicates a wave form when idle stapling occurs (the needle does not penetrate through the sheet bundle even when the stapler 400 is operated). Upon the idle stapling, since there is no load when the needle H penetrates through the sheet bundle S or when the needle is bent, the current value is decreased. Incidentally, W3 indicates a wave form when the poor stapling or the needle jam occurs. In this case, generally, since overload is generated, the current value is increased remarkably. Accordingly, it can be determined that the normal stapling is effected when the current level is $I_0$ value (initial set value) or therearound, and it can be determined that the needle jam, poor stapling or abnormality of a mechanism of the stapler occurs when $I>(I_0+C)$ (C=dispersion), and further, it can be determined that the idle stapling occurs when $I<(I_0-C)$. Incidentally, the operator is informed of the needle absence condition or the needle jam condition of the stapler 400 through a display portion using an LED and the like.

Next, the stapling operation of the stapler 400 will be explained.

Figure 28:
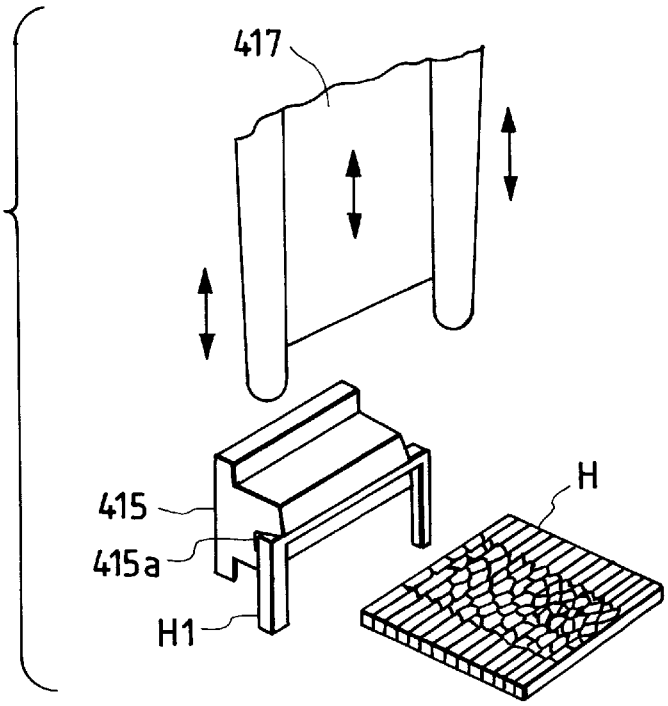
FIG. 28 is an explanatory view showing a condition that a central portion of a first staple needle is held by a holding groove of a needle bending block.

The plate-shaped staple needles H contained in the needle cartridge 403 are fed out one by one from the lowermost one by the feed roller 405, and the fed-out needle is sent to a needle bending block 415 as shown in FIG. 28, where a central portion of the first needle Hi is held in a holding groove 415*a* of the needle bending block 415.

Figure 29:
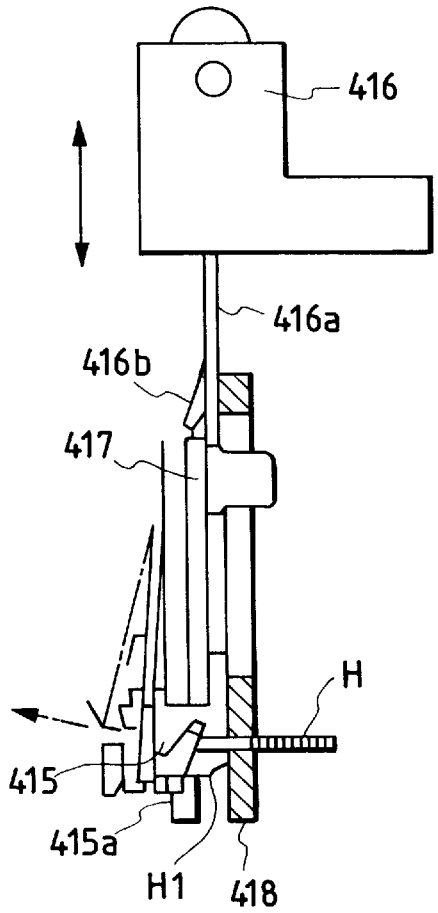
FIG. 29 is an explanatory view showing a stapling step of a forming portion of the stapler.

Thereafter, when the forming portion 401 is shifted to a lower operating position by rotating the eccentric cam gear 408, as shown in FIG. 29, a driver 416 is pushed downwardly by a drive mechanism (not shown), thereby shifting a plunger 416*a* downwardly. In this case, a U-shape bending block 417 is pushed by a push pawl 416*b* formed on the plunger 416*a*, thereby urging the block 417 against the needle bending block 415. As a result, as shown in FIG. 28, the staple needle H held in the holding groove 415*a* of the needle bending block 415 is bent to a U-shaped condition.

Thereafter, the plunger 416*a* is further pushed downwardly, so that the push pawl 416*b* is disengaged from the U-shape bending block 417, with the result that only the plunger 416*a* is further pushed downwardly to reach a tapered portion of the needle bending block 415. The plunger 416*a* brings the first needle H1 alone to a needle cutting member 418 while shifting the needle bending block 415 to a position shown by the dot-and-chain line in FIG. 29. In the needle cutting member 418, the needle H1 is sheared, and the needle is stapled into the sheet bundle S, and then, the needle is pressed against the staple table 402, thereby stapling the sheet bundle S. Thereafter, when the forming portion 401 is shifted to an upper waiting position by further rotation of the eccentric cam gear 408, the driver 416 and the plunger 416*a* are shifted upwardly to reach their waiting positions. In this way, one process of the stapling operation is finished.

Next, the sheet post-treatment of the sheet stacking apparatus having the staple unit 400A will be explained.

Figure 30:
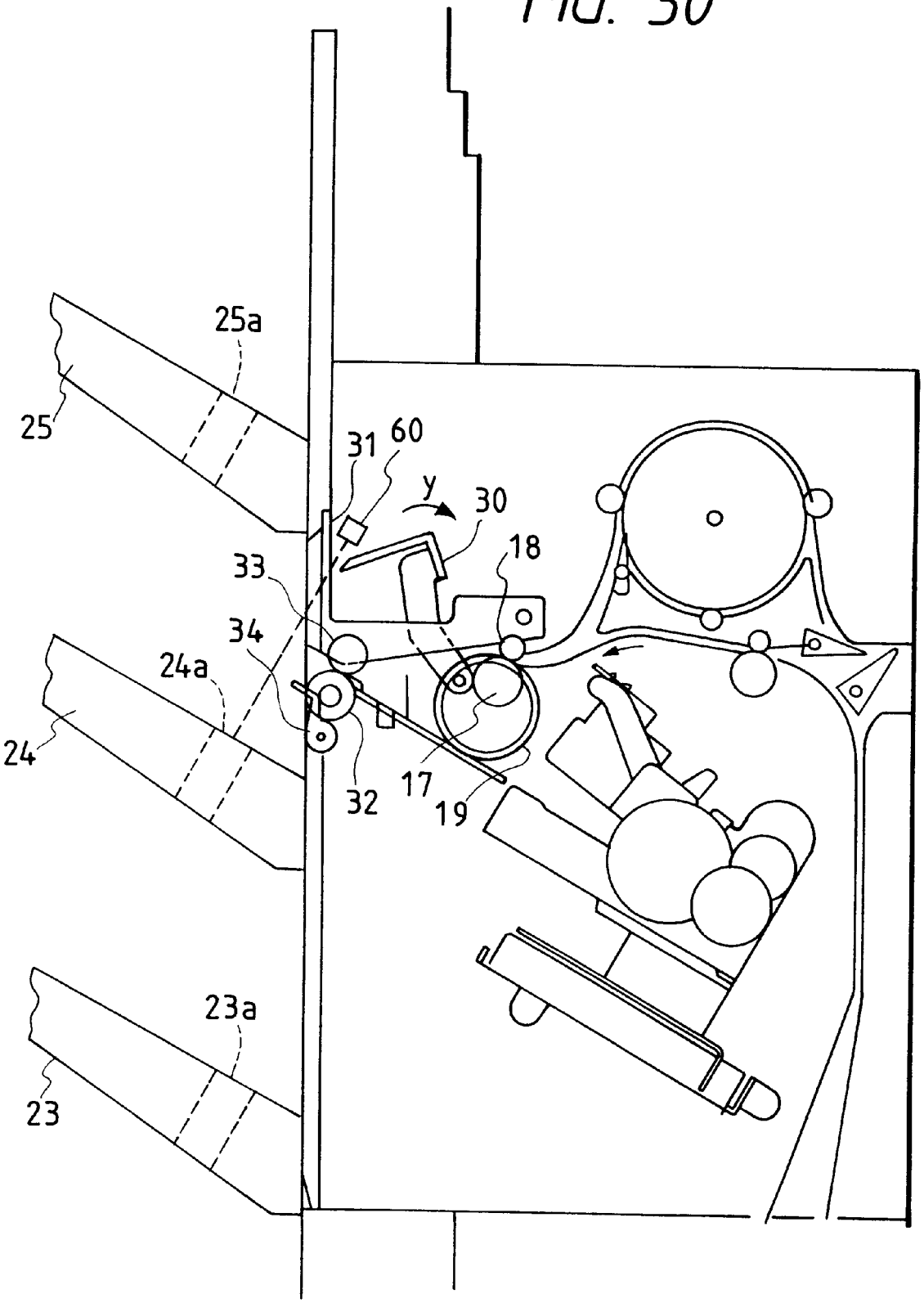
FIG. 30 is an explanatory view showing a condition wherein a sheet is discharged on a second tray of the sheet stacking apparatus.
Figure 31:
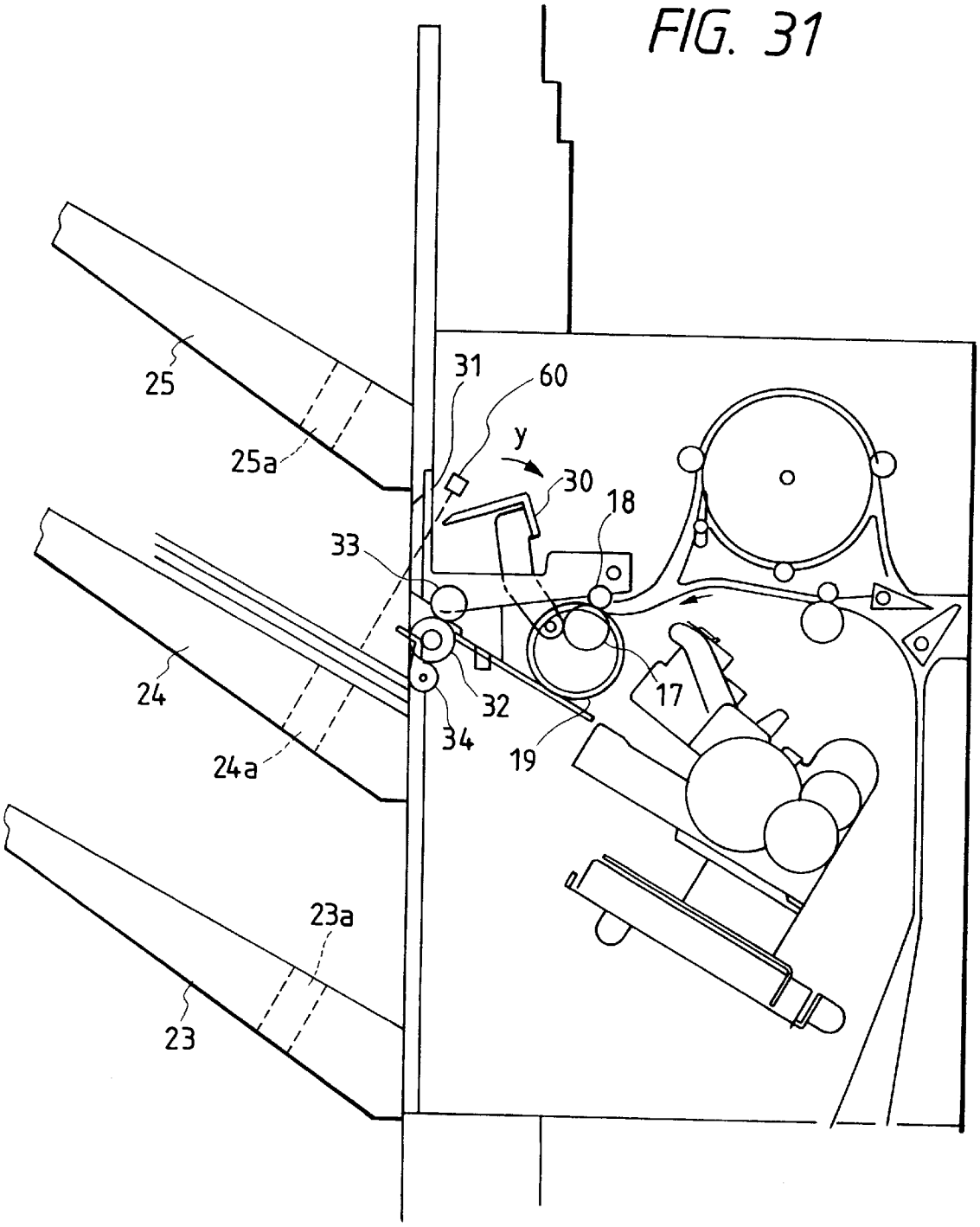
FIG. 31 is an explanatory view showing a condition wherein the sheets were discharged on the second tray of the sheet stacking apparatus.

When the sheet bundle is discharged without the stapling operation, the sheet bundle is directly discharged onto the first, second or third tray 23, 24 or 25. FIG. 30 shows a case where the sheet is discharged onto the second tray 24.

Figure 7:
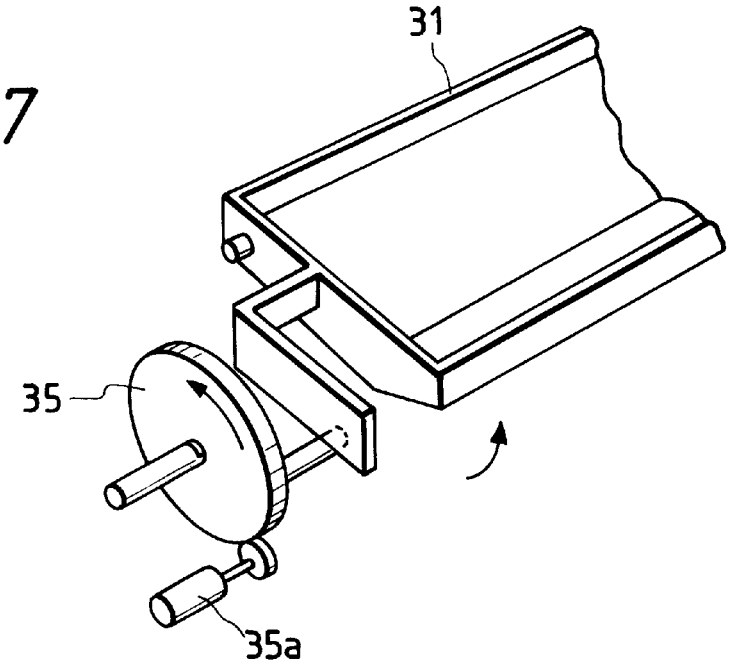
FIG. 7 is an explanatory view showing a condition wherein a rockable guide of the sheet stacking apparatus is rocked.

When the non-staple mode is selected by the operator, the cam 35 shown in FIG. 7 is rotated in the direction shown by the arrow by means of the discharge motor 35*a*, with the result that, as shown in FIG. 6, the rockable guide 31 is rocked around the pivot shaft 31*a* so that the discharge rollers 32 and 33 are urged against each other. Incidentally, in this case, the stopper 30 for closing the discharge opening 50 is rotated in the direction shown by the arrow with respect to the rockable guide 31 and is stopped there.

In this condition, the sheet discharged from the copying machine 100 is passed through the convey path shown in FIG. 2 and is further conveyed toward a downstream side by the pairs of rollers 5, 17. Then, the sheet is directed toward the tray 24 by the rockable guide 31 and then is passed through the rollers 32 and 33 to be discharged onto the tray through the discharge opening 50. In this way, the sheets are successively stacked on the tray 24.

On the other hand, when a large number of normal copies are formed, first of all, it is ascertained that there is no sheet on the first tray 23 by the distance sensor 60. To this end, as mentioned above, the CPU 600 causes the distance sensor 60 to emit the light toward the first tray 23, thereby measuring the time for receiving the reflected light. In this case, since the measured time becomes longer than the second predetermined time, the CPU 600 judges that there is no sheet on the tray. After it is ascertained that there is no sheet on the tray 23, the tray 23 is shifted to the position where the first sheet is discharged, in order to stack the sheets from the present tray height.

When a predetermined number of sheets are stacked, the tray unit 26 is lowered to a position where the upper surface of the sheet stack on the tray becomes substantially the same as the tray surface on which the first sheet was discharged. The above-mentioned operation is repeated. When it is detected that a maximum amount of sheets are stacked on the tray, a stop signal is sent to the copying machine, thereby stopping the discharging of sheets temporarily.

Then, in order to stack the sheets on the second tray 24, the tray unit 24 is lowered to the position where the first sheet is discharged onto the tray 24. Thereafter, the copying operation of the copying machine 100 is re-started, thereby stacking the copied sheets on the tray. Thereafter, the above-mentioned operation is repeated until a maximum amount of sheets are stacked on the tray 24. Incidentally, when the sheets are stacked on the third tray 25, a similar operation is effected.

In the illustrated embodiment, as mentioned above, the copying machine 100 is of digital type in which not only the original sent from the ADF 300 or the original rested on the original platen glass can be read to be copied but also the machine can be used as a facsimile or a printer for a personal computer by using the interface 500.

In order to use the copying machine in this way, it is necessary to sort and stack the sheets on the different trays or to stack the sheets on the tray which is designated by the operator. To this end, in the illustrated embodiment, for example, the output sheets from the facsimile are stacked on the first tray 23, the output sheets from the personal computer are stacked on the second tray 24, and the copied sheets are stacked on the third tray 25 in the copy mode. Now, the operations for discharging the sheets in this way will be explained.

First of all, a case where the copied sheets are stacked in the copy mode (i.e., stacked on the third tray 25) from a condition that a certain number of output sheets were discharged from the personal computer onto the second tray 24 will be described. When the sheet stacking apparatus 1 is powered ON, the CPU 600 performs the initialization of the I/O ports and the memory (RAM) and then sets the communication mode to the FAX, printer and copying machine.

Thereafter, when the copied sheets are stacked on the third tray 25 from the condition that a certain number of output sheets were discharged from the personal computer onto the second tray 24, the tray unit 26 is lowered to a position where the first sheet is discharged onto the third tray 25. This operation is the same as that in the copy mode, except that the unit is lowered even when the maximum amount of sheets are not stacked on the tray.

Next, a case where the output sheets from the facsimile are stacked (i.e., stacked on the first tray 23) from a condition wherein a certain number of output sheets were discharged from the personal computer onto the second tray 24 will be described.

In this case, in the condition wherein the sheets were stacked on the second tray 24, the tray unit 26 is lifted to permit stacking of the sheets on the first tray 23. In this case, in order to prevent the sheet from entering into a space F shown by the hatched area in FIG. 6, as shown in FIG. 8, the stopper 30 is rotated around the pivot pin 30*a* from the broken line position to the solid line position in FIG. 8, thereby closing the space F. Thus, the tray 24 on which the sheets were stacked can be shifted upwardly without any trouble. Consequently, since the tray on which the sheets were stacked can be moved across the discharge opening 50, the ability of the copying machine 100 having the interface can be realized adequately.

Next, the stapling operation of the sheet stacking apparatus will be explained.

First of all, in the staple sort mode, the sheets are not directly stacked on the trays 23, 24 and 25, but are stacked on the staple tray 38 (FIG. 2) temporarily. When the staple sort mode is selected by the operator, as shown in FIG. 9, the rockable guide 31 is rocked upwardly to release the discharge opening 50 and to separate the discharge rollers 32 and 33 from each other. When the rockable guide 31 is rocked in this way, as mentioned above, roller guide 34 is held in flush with the lower net guide 27*a* by the spring 37, and the sheet stopper portion 35 is protruded above the sheet stack Sa on the tray 24.

In this condition, the sheet discharged from the copying machine 100 is passed through the convey path 6 to reach the pair of rollers 17, 18. Then, the sheet is discharged by the pair of rollers 17, 18. In this case, since the rockable guide 31 was rocked upwardly, the sheet is not discharged but is rested on the staple tray 38. In this case, the tray 24 is positioned higher than that in the non-staple mode, so that, as shown in FIG. 32, the tray 24 supports the trail end of the sheet S, thereby helping the returning of the sheet to the upstream side of the discharging direction.

Figure 32:
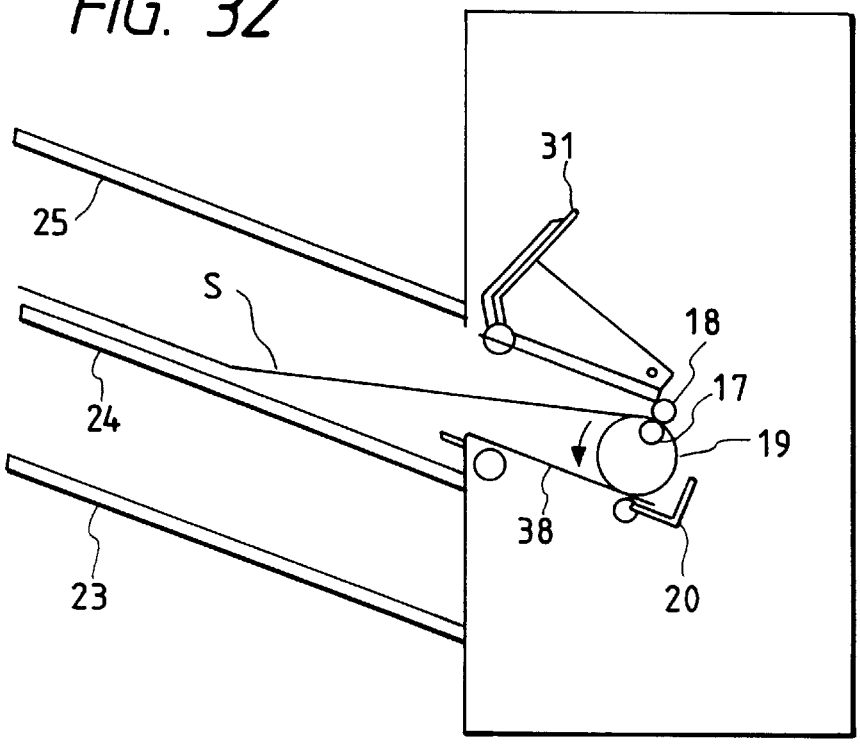
FIG. 32 is an explanatory view showing a condition of the second tray in a staple sort mode.

On the other hand, as shown in FIG. 32, the sheet S discharged on the staple tray 38 is moved by its own weight toward an upstream side of the discharging direction with the aid of the inclination of the staple tray 38 and by increasing the sheet dropping position from the tray 24. However, the sheet is further biased toward an upstream side of the staple tray 38 by a discharge align belt 19 rotated in synchronous with the discharge roller 17.

As a result, the sheet S abuts against the abutment plate 20, thereby aligning the sheet in the direction perpendicular to the discharging direction. Further, regarding the alignment of the sheet in the width-wise direction, the side align guide 21 (FIGS. 3 and 4) starts to operate at a predetermined time when the sheet dropped on the staple tray 38 abuts against the abutment plate 20 and is shifted from the rear side to the front side by a predetermined distance smaller than a width of the sheet, thereby aligning the sheet S at the front side. This operation is repeated until all of the sheets are stacked on the staple tray.

Figure 33:
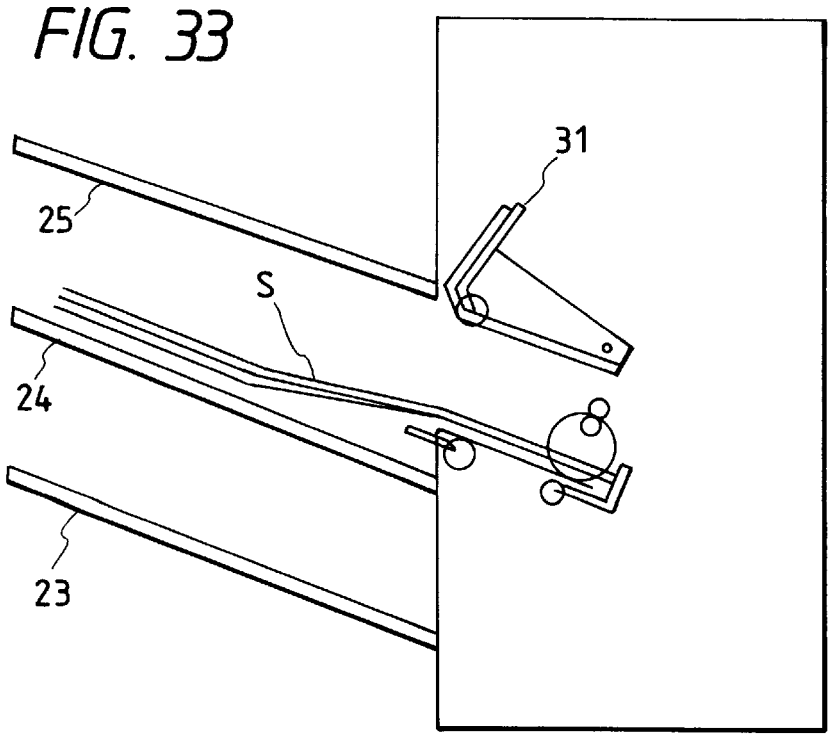
FIG. 33 is an explanatory view showing a condition wherein a number of sheets set by an operator are aligned on a staple tray.
Figure 34:
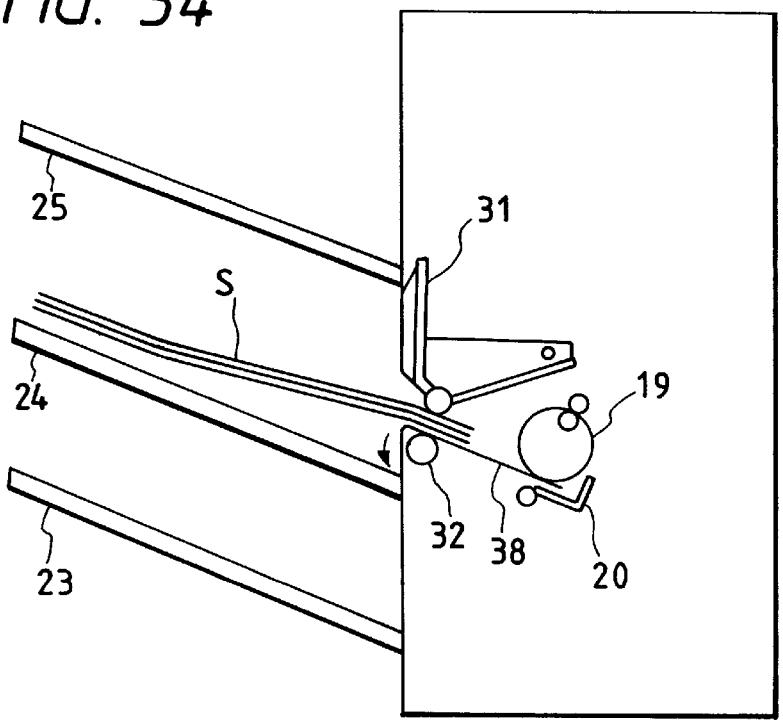
FIG. 34 is an explanatory view showing a condition wherein a stapled sheets bundle is discharged.
Figure 35:
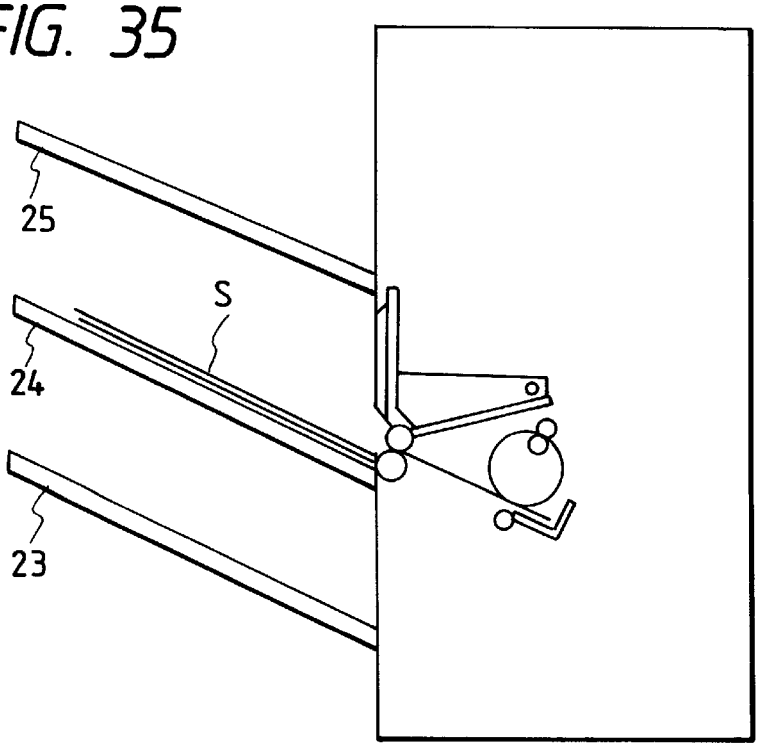
FIG. 35 is an explanatory view showing a condition wherein a stapled sheets bundle was discharged.

As shown in FIG. 33, when the predetermined number (set by the operator) of sheets are aligned with each other on the staple tray 38, the stapler is operated to effect the stapling operation so that the needles are stapled at positions set by the operator. When the stapling operation is finished, as shown in FIG. 34, the rockable guide 31 is lowered and the discharge roller 32 is rotated in the direction shown by the arrow, with the result that, as shown in FIG. 35, the stapled sheet bundle S is discharged.

Figure 36:
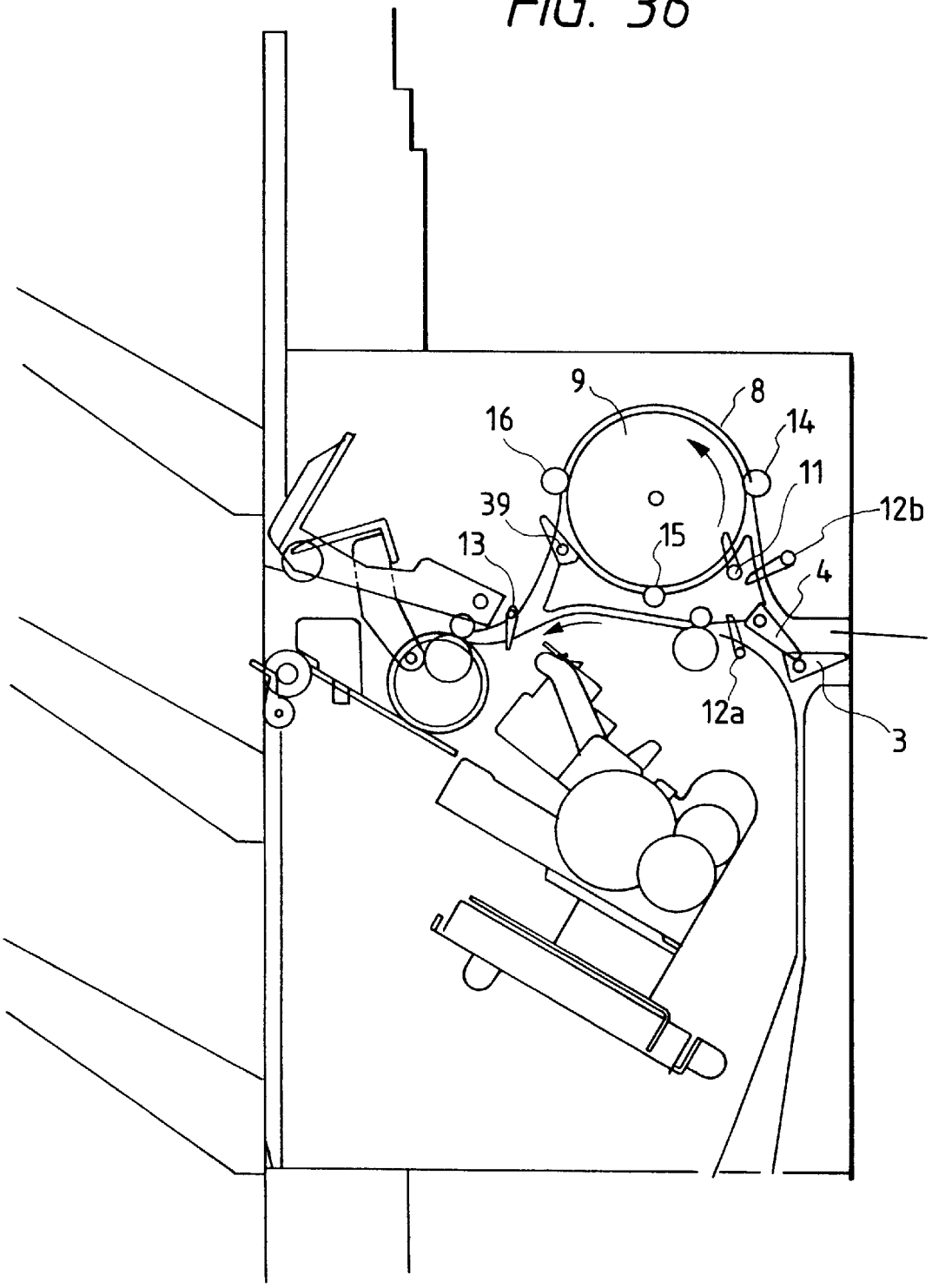
FIG. 36 is an explanatory view showing a condition wherein the sheet starts to enter into the sheet stacking apparatus.

In the stapling operation, since the sheets are successively discharged from the copying machine 100, the first discharge sheet of the next job is trapped in the sheet stacking apparatus 1 and the second sheet is overlapped with the first sheet and then is discharged together with the first sheet. This operation will be explained with reference to FIGS. 36 to 39 (Incidentally, FIG. 36 shows a condition that the sheet starts to enter into the sheet stacking apparatus).

The first sheet S1 discharged from the copying machine 100 is sent to a buffer path 8 since the upstream ends of the flappers 3 and 4 were shifted downwardly. Then, the sheet is conveyed to the direction shown by the arrow around a buffer roller 9. Now, a flapper 39 is rotated so that the sheet is sent to a roller 15. When the tip end of the sheet S1 is detected by a sensor 11, the sheet is stopped in a condition as shown in FIG. 37.

Figure 37:
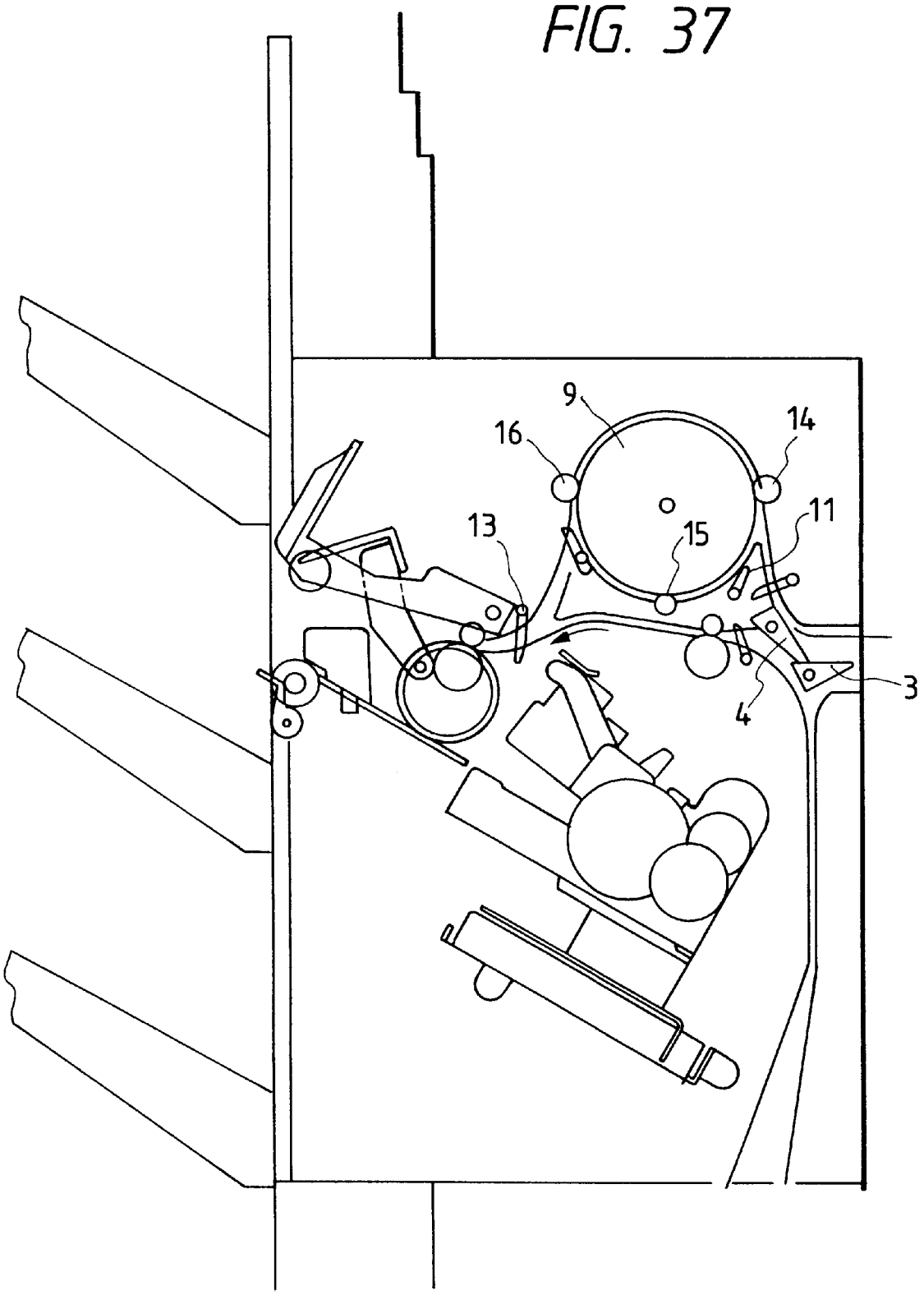
FIG. 37 is an explanatory view showing a condition wherein a first sheet is wound around a buffer roller.
Figure 38:
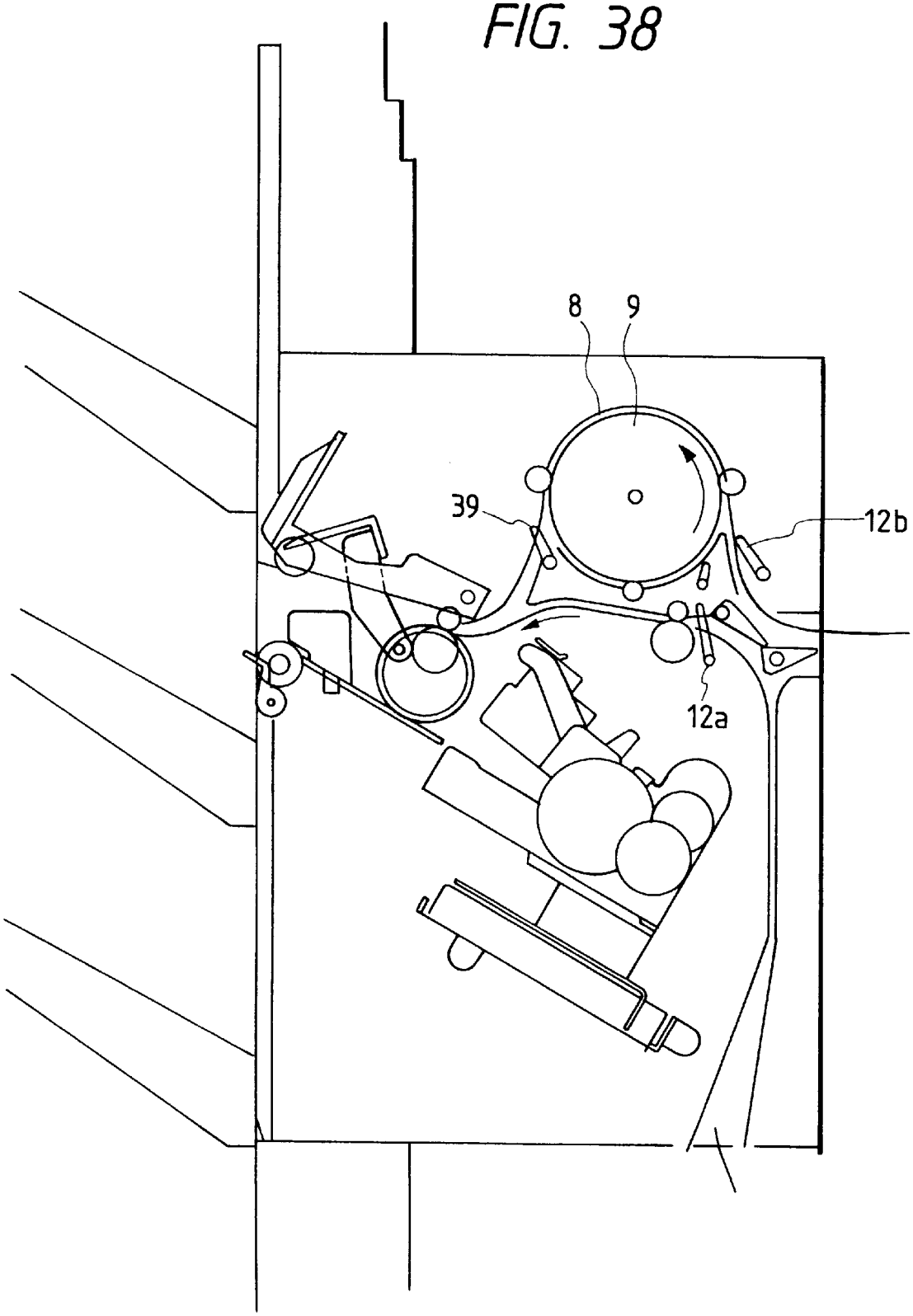
FIG. 38 is an explanatory view showing a condition wherein first and second sheets are conveyed in an overlapped condition.
Figure 39:
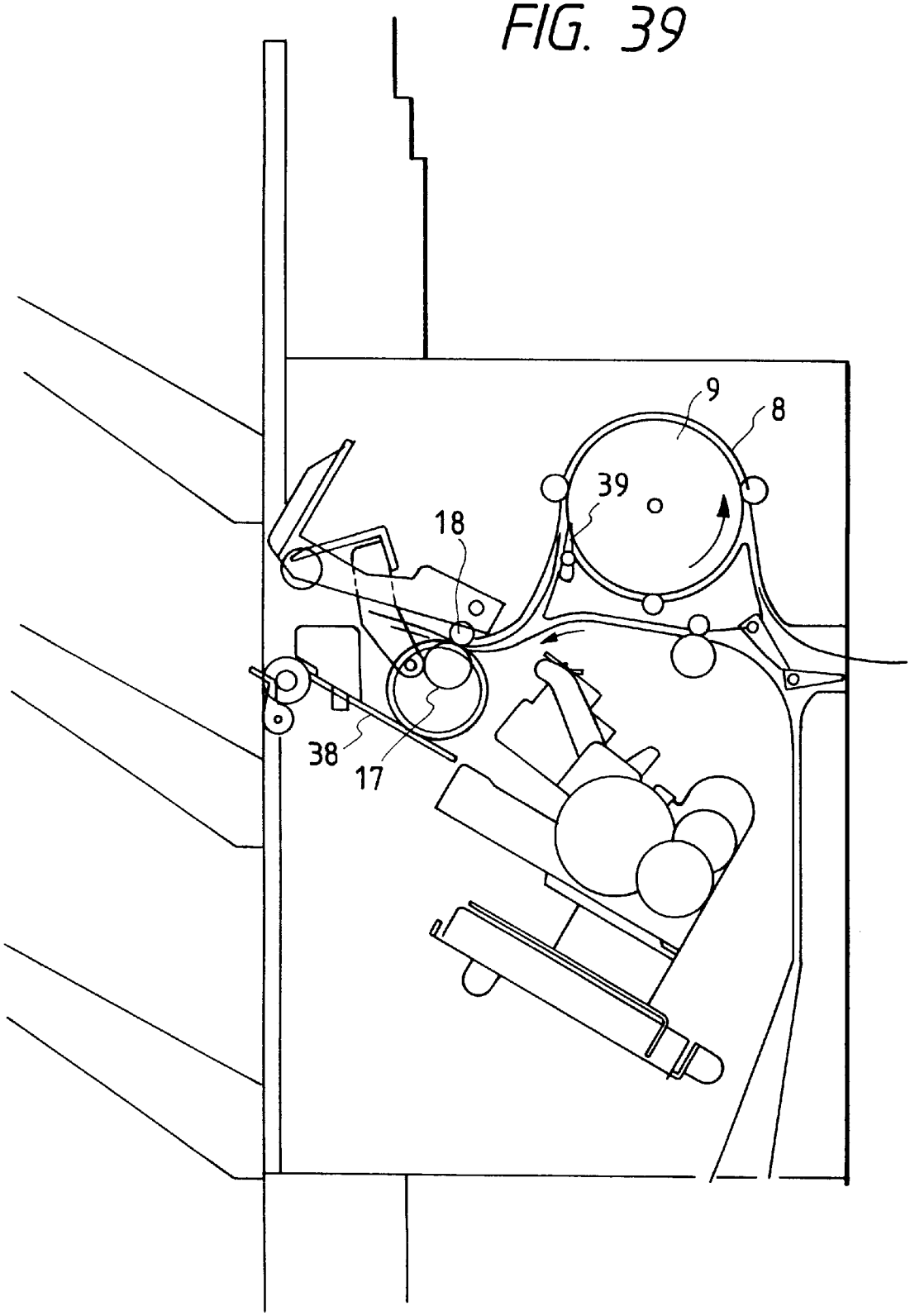
FIG. 39 is an explanatory view showing a condition wherein two sheets are discharged in an overlapped condition.

As shown in FIG. 37, when the second sheet S2 enters into the sheet stacking apparatus, the buffer roller 9 starts to rotate to convey the first and second sheets S1 and S2 in an overlapped condition, as shown in FIG. 38. When the trail end of the first sheet S1 leaves the flapper 39, as shown in FIG. 39, the flapper 39 is rotated so that the sheets are sent toward the discharge rollers 17 and 18, with the result that two sheets are discharged on the staple tray 38 in the overlapped condition. By performing the above operation, during the stapling operation, the sheet is discharged from the discharge rollers 17 and 18. Thus, the stapling operation can be carried out and the copying machine 100 is not stopped. Incidentally, in order to increase the stapling time, three or more sheets may be wound around the buffer roller 9.

By repeating the above-mentioned operation, a plurality of stapled copy bundles Sa can be produced. As shown in FIG. 9, when the stapled copy bundle Sa was already rested on the tray 24, if an upper end of the copy bundle Sa upwardly exceeds the point G due to the flexion and/or expansion of the copy bundle Sa, the next sheet will be caught by the copy bundle to generate the sheet jam or the copy bundle will interfere with the side align guide to worsen the aligning ability.

However, in this case, since the roller guide 34 is positioned in flush with the lower net guide 27*a* and the stopper member 35 is protruded above the tray 24 to hold down the upper surface of the copy bundle Sa on the tray 24, the upper end of the copy bundle Sa rested on the tray does not exceed the point G.

Next, another embodiment of the present invention will be explained with reference to FIGS. 40 and 41. Incidentally, the reference numerals which are not particularly explained designate the same elements shown in FIGS. 5 and 14.

Figure 40:
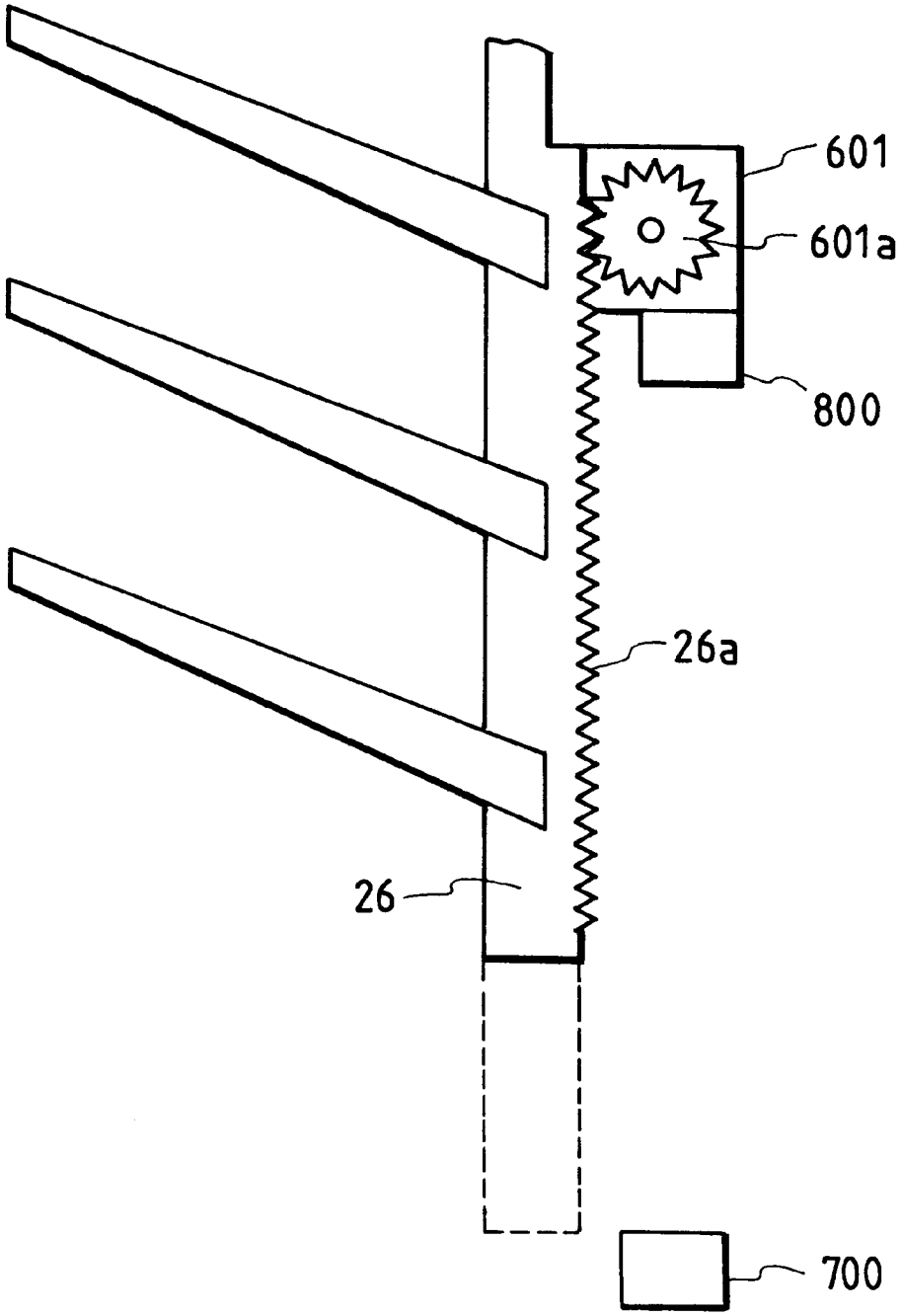
FIG. 40 is a side view showing an alteration of the tray unit of FIG. 5.
Figure 41:
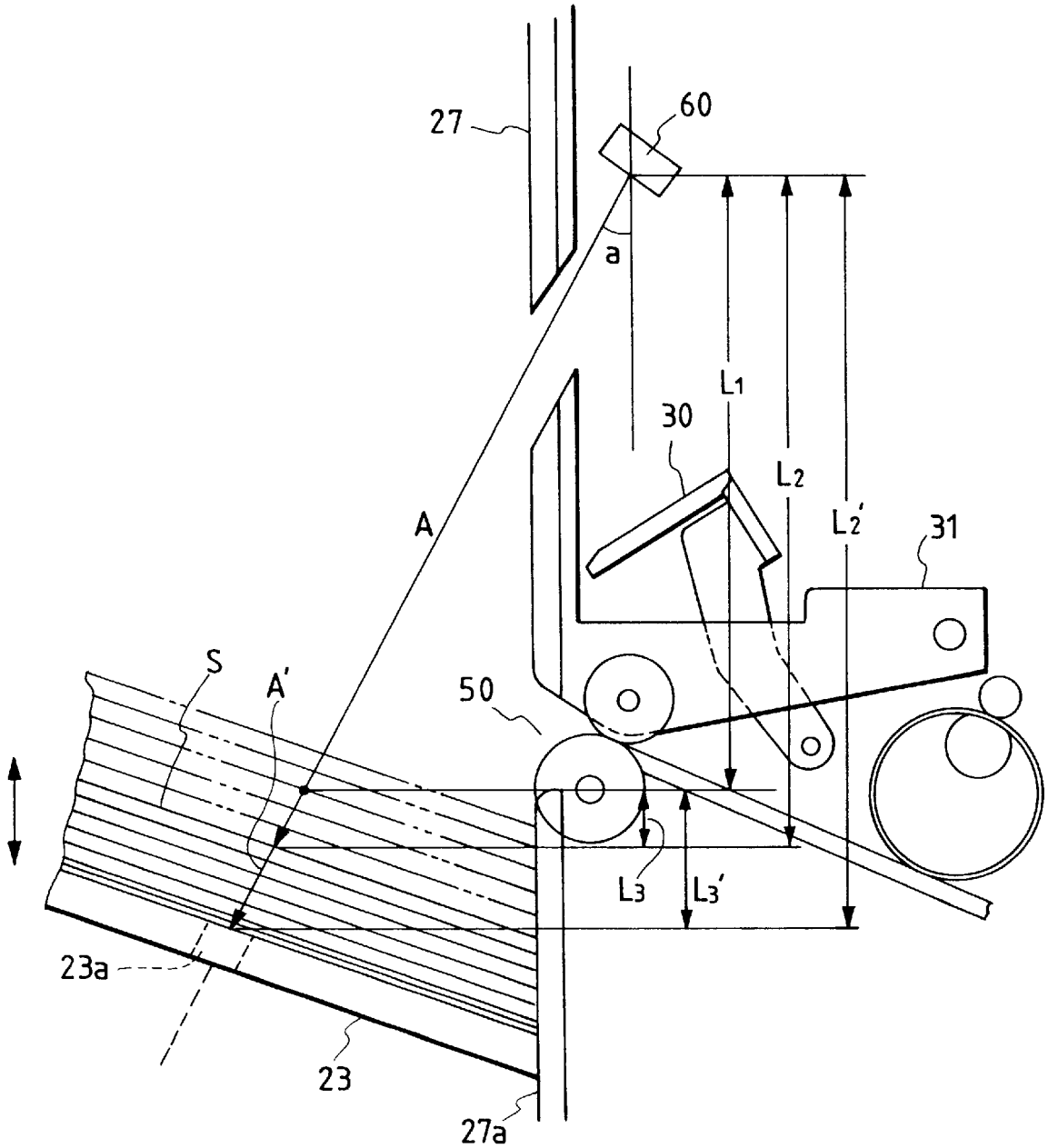
FIG. 41 is an explanatory view showing an alteration of the principle of FIG. 14.
Figure 42:
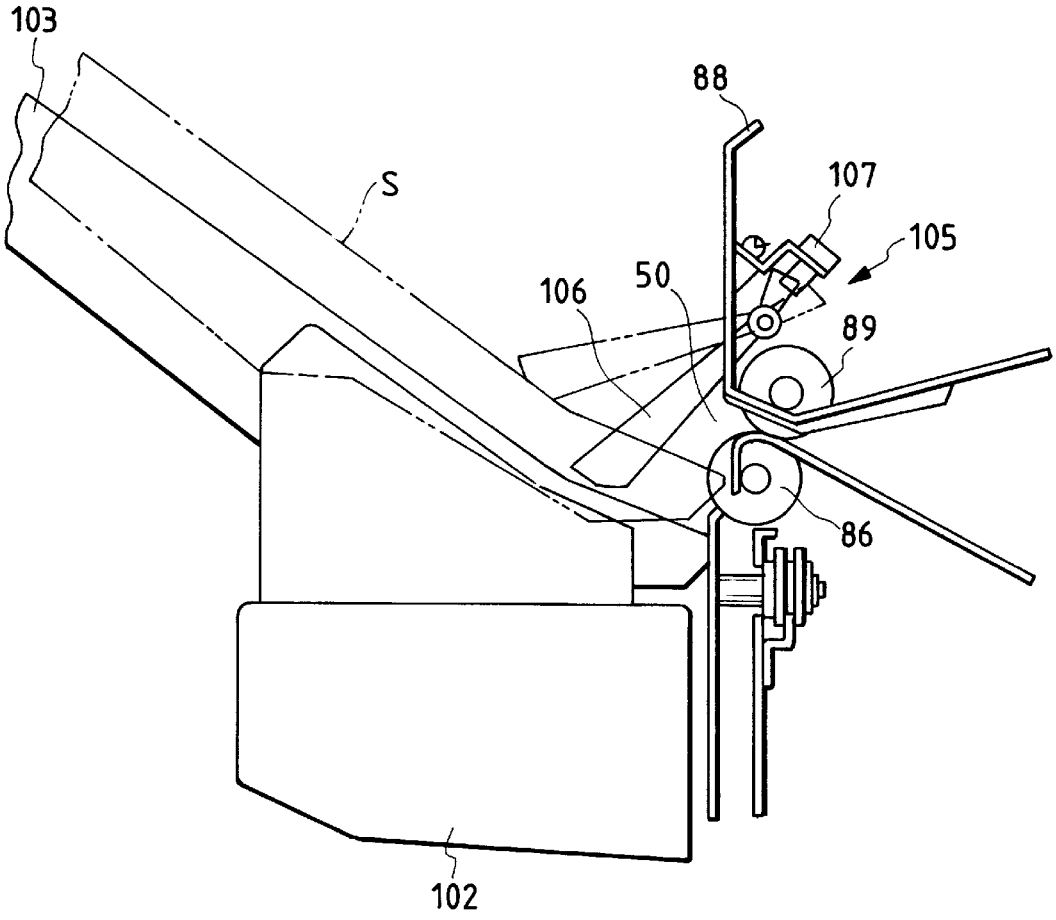
FIG. 42 RELATED ART
FIG. 42 is a side view of a main portion of a conventional sheet stacking apparatus.

In FIG. 40, a sensor S700 and a shift clock sensor S800 are connected to the input side of the CPU 600. For example, the sensor S700 serves to detect the fact that the tray unit 26 is positioned at the lowermost position, and the shift clock sensor S800 serves to count the number of clocks of the shift motor 601 to thereby measure the shift amount of the tray unit 26. The CPU 600 can detect the amount of the tray unit 26 is lifted from the lowermost position on the basis of signals from the sensors S700, S800 and can determine whether the tray is shifted to the home position on the basis of the detected amount.

When the determined distance A becomes shorter than the first predetermined distance indicating the fact that the sheets are stacked in the tray 23 by a predetermined height (for example, height for preventing the discharging of the sheets), the shift motor 601 is driven through the driver D6 to shift the tray unit 26 downwardly to thereby lower the tray 23 so that the discharging of sheets is not prevented.

Incidentally, after the tray 23 reaches the lowermost position by successively lowering the tray 23, when the determined distance A becomes shorter than the first predetermined distance, it is determined that the maximum amount of sheets are stacked on the tray 23, and the tray unit 26 is shifted so that further sheets can be stacked on another tray.

In this way, by determining the height of the sheet stacking surface or the tray at the predetermined timing after the post-treatment by means of the distance sensor 60 of non-contact type, even when a plurality of trays are provided, the control of the positions of the trays can be properly effected without interference with the distance sensor 60.

According to the illustrated embodiments, since the sheet stacking condition of the sheet stacking plate can be determined by the distance sensor of non-contact type and the sheet stacking plate can be shifted on the basis of the determined result, the control of the position of the sheet stacking plate can be effected without interference with the distance sensor.

What is claimed is:

1. An apparatus for stacking discharged sheets on a sheet stacking plate, comprising:

a drive device for shifting the sheet stacking plate in an up-and-down direction;

a distance sensor of a non-contact type disposed above said sheet stacking plate, and having a light illumination portion illuminating the sheet stacking plate with illumination light and a light receiving portion for receiving reflected light; and a control device for determining the distance between said distance sensor and a sheet stack resting on the sheet stacking plate, for determining a sheet stacking condition of the sheet stacking plate on the basis of the determined distance, and for controlling a driving of said drive device to shift the sheet stacking plate on the basis of the sheet stacking condition, wherein said control device determines that an upper surface of the sheet stacked on the sheet stacking plate reaches to a height position which is predetermined when the distance becomes shorter than a first predetermined distance, to thereby drive said drive device to lower the sheet stacking plate.

2. An apparatus according to claim 1, further comprising stapling means, and wherein said light receiving portion of said distance sensor includes a light receiving element, and said illumination portion is designed to emit light every time when the sheet bundle bound by said stapling means is discharged onto the sheet stacking plate.

3. An apparatus according to claim 1, wherein said control device determines that no sheet is stacked on said sheet stacking plate when said distance is longer than a second predetermined distance.

4. An apparatus according to claim 3, wherein the sheet stacking plate includes a through opening for permitting passage of the illumination light from said distance sensor so that, when no sheet is stacked on the sheet stacking plate, the illumination light is passed through said through opening to indicate the fact that the distance becomes longer than the second predetermined distance.

5. An apparatus for stacking discharged sheets on a sheet stacking plate, comprising:

a distance sensor of a non-contact type disposed above the sheet stacking plate, and having a light illumination portion for illuminating the sheet stacking plate with illumination light and a light receiving portion for receiving reflected light;

a control device for determining the distance between said distance sensor and a sheet stack resting on the sheet stacking plate, and determining a sheet stacking condition of the sheet stacking plate on the basis of the determined distance;

a drive device for shifting the sheet stacking plate in an up-and-down direction; and stacking plate position detection means for detecting a height position of the sheet stacking plate;

wherein said control device determines the distance between said distance sensor and a sheet stack resting on said sheet stacking plate and determines a sheet stacking height on said sheet stacking plate on the basis of the determined distance and the height position detected by said stacking plate position detection means, and controls said drive device to shift the sheet stacking plate on the basis of a determined result.

6. An apparatus according to claim 5, further comprising stapling means, and wherein said light receiving portion of said distance sensor includes a light receiving element and said illumination portion is designed to emit the light every time when the sheet bundle bound by said stapling means is discharged onto the sheet stacking plate.

7. An apparatus according to claim 5, wherein said control device determines that a maximum amount of sheets are stacked on the sheet stacking plate when the sheet stacking height becomes greater than a first predetermined height.

8. An apparatus according to claim 5, wherein said control device determines that no sheet is stacked on the sheet stacking plate when the distance measured by said sensor is longer than the distance to the position of the sheet stacking plate.

9. An apparatus according to claim 8, wherein the sheet stacking plate includes a through opening for permitting passage of the illumination light from said distance sensor so that, when no sheet is stacked on said sheet stacking plate, the illumination light is passed through said through opening.

10. An apparatus according to claim 5, wherein a plurality of sheet stacking plates are provided along a vertical direction.

11. An apparatus according to claim 10, wherein said plurality of sheet stacking plates are integrally shifted in the vertical direction, and each stacking plate is positioned at one sheet discharge port by said plate position detection means.

12. An apparatus according to claim 10, wherein, when electric power to said apparatus is turned ON, initialization for returning the sheet stacking plate to a home position is effected, and, after the returning of the sheet stacking plate is completed, the following processes are performed:

(a) the distance is measured by said distance sensor, and the measured distance data D is compared with a reference data D1;

(b) when there is no sheet on said sheet stacking plate, the distance data D becomes greater than the reference distance data D1 since a through hole is not closed by the sheet, and, in this case, it is determined that no sheet is stacked on the sheet stacking plate, and a first sheet is stacked at a present height of the sheet stacking plate;

(c) when the reference data D1 is greater than the measured distance data D, a sheet stacking plate shift amount data B is determined on the basis of the difference between the sheet stacking height data D and sheet height reference data D2 corresponding to a predetermined sheet surface height, and it is determined whether the sheet stacking plate shift amount data B is zero, that is, the present stacked sheet height is a maximum sheet stacking amount, and, if the present sheet stacked height is the maximum sheet stacking amount, the sheet is stacked on a next sheet stacking plate; and (d) if the present stacked sheet height is not the maximum sheet stacking amount, the sheet stacking plate is shifted by a distance corresponding to the sheet stacking plate shift amount data B.

13. An apparatus according to claim 5, further comprising a stapling device disposed at an upstream side of a discharge opening to the sheet stacking plate for stapling the sheets trapped as a sheet bundle and then discharging the stapled sheet bundle onto the sheet stacking plate.

14. An apparatus according to claim 5, wherein, when a signal from a CPU is inputted to said distance sensor, said distance sensor causes a burst wave generate circuit to generate a trigger signal to thereby illuminate a light emitting element, and outputs voltage information corresponding to a light receiving position of a light receiving element to said CPU, to thereby determine the distance from stored data on the basis of magnitude of the voltage information.

15. An image forming apparatus comprising:

an image forming portion; and a sheet stacking apparatus for stacking discharged sheets on a sheet stacking plate, said sheet stacking apparatus comprising:

a drive device for shifting said sheet stacking plate in an up-and-down-direction;

a distance sensor of a non-contact type disposed above said sheet stacking plate, and having a light illumination portion for illuminating said sheet stacking plate with illumination light and a light receiving portion for receiving reflected light; and a control device for determining the distance between said distance sensor and a sheet stack resting on said sheet stacking plate, for determining a sheet stacking condition of said sheet stacking plate on the basis of the determined distance, and for controlling the driving of said drive device to shift said sheet stacking plate on the basis of the sheet stacking condition, wherein said control device determines that an upper surface of the sheet stacked on the sheet stacking plate reaches to a height position which is predetermined when the distance becomes shorter than a first predetermined distance to thereby drive said drive device to stacking plate.

16. An image forming apparatus according to claim 15, said image forming apparatus further comprising stapling means, and wherein said light receiving portion of said distance sensor includes a light receiving element, and said illumination portion is designed to emit the illumination light every time when the sheet bundle bound by said stapling means is discharged onto the sheet stacking plate.

17. An image forming apparatus according to claim 15, wherein said control device determines that no sheet is stacked on said sheet stacking plate when said distance is longer than a second predetermined distance.

18. An image forming apparatus according to claim 17, wherein said sheet stacking plate includes a through opening for permitting passage of the illumination light from said distance sensor so that, when no sheet is stacked on said sheet stacking plate, the illumination light is passed through said through opening to indicate the fact that said distance is longer than the second predetermined distance.

19. An image forming apparatus, comprising:

an image forming portion; and a sheet stacking apparatus for stacking discharged sheets on a sheet stacking plate, said sheet stacking apparatus comprising:

a distance sensor of a non-contact type disposed above said sheet stacking plate, and having a light illumination portion for illuminating said sheet stacking plate with illumination light and a light receiving portion for receiving reflected light;

a control device for determining the distance between said distance sensor and a sheet stack resting on said sheet stacking plate, and for determining a sheet stacking condition of said sheet stacking plate on the basis of the determined distance; and a drive device for shifting said sheet stacking plate in an up-and-down direction; and stacking plate position detection means for detecting the height position of said sheet stacking plate;

wherein said control device determines the distance between said distance sensor and a sheet stack resting on said sheet stacking plate, determines the sheet stacking height on said sheet stacking plate on the basis of the determined distance and the height position detected by said stacking plate position detection means, and controls said drive device to shift said sheet stacking plate on the basis of a determined result.

20. An image forming apparatus according to claim 19, said image forming apparatus further comprising stapling means, and wherein said light receiving portion of said distance sensor includes a light receiving element and said illumination portion is designed to emit the illumination light every time when the sheet bundle bound by said stapling means is discharged onto the sheet stacking plate.

21. An image forming apparatus according to claim 19, wherein said control device determines that a maximum amount of sheets are stacked on said sheet stacking plate when the sheet stacking height becomes greater than a first predetermined height.

22. An image forming apparatus according to claim 19, wherein said control device determines that no sheet is stacked on said sheet stacking plate when the distance measured by said sensor is longer than the distance to the height position.

23. An image forming apparatus according to claim 22, wherein said sheet stacking plate includes a through opening for permitting passage of the illumination light from said distance sensor so that, when no sheet is stacked on said sheet stacking plate, the illumination light is passed through said through opening.

24. An image forming apparatus according to claim 19, wherein a plurality of sheet stacking plates are provided along a vertical direction.

25. An image forming apparatus according to claim 24, wherein said plurality of sheet stacking plates are integrally shifted in the vertical direction, and each stacking plate is positioned at one sheet discharge port by said stacking plate position detection means.

26. An image forming apparatus according to claim 19, said image forming apparatus further comprising a stapling device disposed at an upstream side of a discharge opening to said sheet stacking plate for stapling the sheets trapped as a sheet bundle and then discharging the stapled sheet bundle onto said sheet stacking plate.

27. An image forming apparatus according to claim 19, wherein, when a signal from a CPU is inputted to said distance sensor, said distance sensor causes a burst wave generate circuit to generate a trigger signal to thereby illuminate a light emitting element, and outputs voltage information corresponding to a light receiving position of a light receiving element to said CPU, to thereby determine the distance from stored data on the basis of magnitude of the voltage information.

28. An apparatus for stacking discharged sheets on a sheet stacking plate, comprising:

a distance sensor of a non-contact type disposed above said sheet stacking plate, and having a light illumination portion for illuminating the sheet stacking plate with illumination light and a light receiving portion for receiving reflected light;

a control device for determining the distance between said distance sensor and a sheet stack resting on the sheet stacking plate, and for determining a sheet stacking condition of the sheet stacking plate on the basis of the determined distance;

stacking plate position detection means for detecting a height position of the sheet stacking plate, wherein said control device determines that no sheet is stacked on the sheet stacking plate on the basis of the distance and the height position.

29. An apparatus according to claim 28, wherein the sheet stacking plate includes a through opening for permitting passage of the illumination light from said distance sensor so that, when no sheet is stacked on the sheet stacking plate, the illumination light is passed through said through opening.

30. An apparatus according to claim 1, 5, or 28, further comprising a roller disposed at a sheet discharge port for discharging a sheet, wherein an upper surface position of the sheet stack is determined so that the distance between said roller and the surface of the sheet stack is a predetermined height.

31. An apparatus for stacking discharged sheets on a sheet stacking plate, comprising:

a drive device for shifting the sheet stacking plate in an up-and-down direction;

a distance sensor of a non-contact type disposed above said sheet stacking plate, and having a light illumination portion illuminating the sheet stacking plate with illumination light and a light receiving portion for receiving reflected light; and a control device for determining the distance between said distance sensor and a sheet stack resting on the sheet stacking plate, for determining a sheet stacking condition of the sheet stacking plate on the basis of the determined distance, and for controlling a driving of said drive device to shift the sheet stacking plate on the basis of the sheet stacking condition, wherein said control device determines that a predetermined amount of sheets are stacked on the sheet stacking plate when the distance becomes shorter than a first predetermined distance to thereby drive said drive device to lower the sheet stacking plate.

32. An apparatus according to claim 1, wherein the sheet stacking plate is inclined so that a side near to the sheet discharge opening becomes lower, light from the distance sensor reaches to the sheet stacking plate in a state where it is inclined relative to a normal line, each of the distances corresponds a distance measured in the inclined state of the sheet stacking plate.

33. An apparatus according to claim 32, wherein the distance measured in the inclined state of the sheet stacking plate corresponds to the calculated distance to a corresponding distance in the normal direction.

34. An apparatus according to claim 1, wherein the sheet upper surface reaches the predetermined height position, it is located in a predetermined position below the sheet discharge opening.

35. An apparatus according to claim 34, wherein the predetermined position of the sheet upper surface corresponds to an upper limit position thereof which is predetermined.

36. A sheet stacking apparatus, comprising:

a sheet discharging roller for discharging a sheet;

a sheet stack plate for stacking the discharged sheet thereon;

a shift means for lifting and lowering said sheet stack plate;

an optical sensor disposed above said sheet stack plate to transmit light to the sheet thereon and to receive the light reflected by the sheet, for measuring distance from said optical sensor to the sheet; and control means for controlling said shift means, said control means comparing the measured distance by said optical sensor and a predetermined distance for controlling said means to lower said sheet stack plate, when the measured distance becomes shorter than the predetermined distance, wherein the lowering amount of said sheet stack plate corresponds to an amount so that the sheet upper surface is located below said sheet discharge roller by the predetermined distance.

37. A sheet stacking apparatus according to claim 36, further comprising a detect means for detecting a height position of said sheet stack plate, wherein the height of the sheet bundle on said sheet stack plate is measured based on the height position of said sheet stack plate detected by said detect means and the measured distance.

38. A sheet stacking apparatus according to claim 37, wherein said detect means includes a sensor for detecting a home position of said sheet stack plate and a pulse counter, to detect the shift amount of said sheet stack plate.

39. A sheet stacking apparatus according to claim 38, wherein when the shift amount of said sheet stack plate reaches a predetermined value, said detect means detects the sheets on said sheet stack plate has reached full capacity.

40. A sheet stacking apparatus according to claim 36, wherein said sheet stack plate is inclined so that a side of said sheet discharge roller becomes lower, light from said optical sensor reaches said sheet stack plate in a state where it is inclined relative to a normal line, and each of distances corresponds to a distance measured in the inclined state of said sheet stack plate.

41. A sheet stacking apparatus according to claim 40, wherein the distance measured in the inclined state of said sheet stack plate corresponds to a calculated distance in the normal distance.

42. A sheet stacking apparatus according to claim 3, wherein the second predetermined distance corresponds to a distance where said sheet stacking plate stacks the first sheet thereon.

43. A sheet stacking apparatus according to claim 12, wherein the second predetermined distance corresponds to a distance where said sheet stacking plate stacks the first sheet thereon.

44. An apparatus according to any claims 1, 2, 3, 5, 6, 7, 8, 28, or 29, further comprising a sheet discharge outlet, wherein said distance sensor is disposed on the outlet side to illuminate slantingly and downwardly, and wherein the sheet stacking condition is a distance between said outlet and said sheet stack in a vertical direction.

45. An image forming apparatus according to claim 15, 16, or 17, further comprising a sheet discharge outlet, wherein said distance sensor is disposed on the outlet side to illuminate slantingly and downwardly, and wherein the sheet stacking condition is a distance between said outlet and said sheet stack in a vertical direction.

46. A sheet stacking apparatus, comprising:

a sheet discharging outlet;

a sheet stacking plate for stacking the discharged sheet thereon;

a distance sensor of a non-contact type dispersed above said sheet stacking plate and on the outlet side, and having a light illumination portion for slantingly and downwardly illuminating a light toward said sheet stacking plate and a light receiving portion for receiving reflected light; and a control means for determining a distance between said distance sensor and a sheet stacking stacked on said sheet stacking plate, and judging a sheet stacking condition of distance, wherein said stacking condition is a distance between said outlet and said sheet stack in a vertical direction.

* * * * *

UNITED STATES PATENT AND TRADEMARK OFFICE

CERTIFICATE OF CORRECTION

PATENT NO. : 6,176,480 B1
DATED : January 23, 2001
INVENTOR(S) : Masahiro Yonenuma et al.

It is certified that error appears in the above-identified patent and that said Letters Patent is hereby corrected as shown below:

Column 1,
Line 26, "pivotablly" should read -- pivotably --.

Column 2,
Line 16, "projecting" should read -- illumination --;
Line 17, "illuminating" should read -- projecting --; and
Line 37, "judges" should read -- determines --.

Column 4,
Line 30, "form" should read -- from --; and
Line 56, "that" should read -- wherein --.

Column 16,
Line 25, "penetrates" should read -- penetrated --.

Column 20,
Line 19, "of" should be deleted.

Column 21,
Line 61, "claim 5," should read -- claim 10, --.

Column 23,
Line 13, "stacking" should read -- lower said sheet stacking --.

Column 24,
Line 48, "distance," should read -- distance; and --.

Column 25,
Line 32, "it" should be deleted.

UNITED STATES PATENT AND TRADEMARK OFFICE

CERTIFICATE OF CORRECTION

PATENT NO. : 6,176,480 B1
DATED : January 23, 2001
INVENTOR(S) : Masahiro Yonenuma et al.

It is certified that error appears in the above-identified patent and that said Letters Patent is hereby corrected as shown below:

Column 26,
Line 48, "dispersed," should read -- disposed --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*